US008844740B2

(12) United States Patent
Nemoto et al.

(10) Patent No.: US 8,844,740 B2
(45) Date of Patent: Sep. 30, 2014

(54) FOLDABLE STORAGE BOX

(75) Inventors: Takehiko Nemoto, Yokohama (JP); Nobuyasu Yamada, Toyota (JP); Kazuaki Kurita, Toyota (JP); Masao Wakigami, Toyota (JP)

(73) Assignee: Nifco Inc., Yokohama (JP)

( * ) Notice: Subject to any disclaimer, the term of this patent is extended or adjusted under 35 U.S.C. 154(b) by 185 days.

(21) Appl. No.: 13/322,531

(22) PCT Filed: May 26, 2010

(86) PCT No.: PCT/JP2010/058897
§ 371 (c)(1),
(2), (4) Date: Jan. 23, 2012

(87) PCT Pub. No.: WO2010/137615
PCT Pub. Date: Dec. 2, 2010

(65) Prior Publication Data

US 2012/0111861 A1 May 10, 2012

(30) Foreign Application Priority Data

May 28, 2009 (JP) ..... 2009-129162

(51) Int. Cl.
*B65D 6/18* (2006.01)

(52) U.S. Cl.
USPC ..... 220/4.29; 220/6; 220/666

(58) Field of Classification Search
CPC ..... B65D 11/1853; B65D 11/1846; B65D 11/1813; B65D 11/1806; B65D 11/22; B65D 11/26; B65D 11/28
USPC ..... 220/6, 4.29, 7, 666, 646, 4.28
See application file for complete search history.

(56) References Cited

U.S. PATENT DOCUMENTS

| | | | | |
|---|---|---|---|---|
| 3,865,269 | A * | 2/1975 | Coleman | 220/6 |
| 2008/0029510 | A1 * | 2/2008 | Fisk | 220/7 |

FOREIGN PATENT DOCUMENTS

| | | | |
|---|---|---|---|
| DE | 29709271 | U1 | 7/1997 |
| EP | 2141078 | A * | 1/2010 |
| FR | 2719821 | A1 | 11/1995 |
| GB | 2445637 | A | 7/2008 |
| JP | U S58-17323 | | 2/1983 |
| JP | H06-286752 | | 10/1994 |
| JP | H10-077033 | | 3/1998 |
| JP | H10-20353 | | 8/1998 |
| JP | 2008-087625 | | 4/2008 |

OTHER PUBLICATIONS

Europe Patent Office, "European Search Report for EP 10780570.7," Feb. 6, 2014.

* cited by examiner

*Primary Examiner* — Stephen Castellano
(74) *Attorney, Agent, or Firm* — Manabu Kanesaka

(57) ABSTRACT

To obtain a foldable storage box in which an open state can be easily held.

When a bottom board (36) in a stored state is transitioned to an open state, a pressing part (62) formed on the bottom board (36) presses one projecting part of a V form of a rotating member (64). The rotating member (64) rotates when the rotating member (64) is pressed, and a rod-form lock member (70) connected with the rotating member (64) rotates so as to extend in a horizontal direction. A leading end part of the lock member (70) is thereby inserted into a recessed pocket part (80) formed on a second side wall board (20B). The lock member (70) is disposed so as to span between a first side wall board (20A) and the second side wall board (20B) when the leading end part of the lock member (70) is inserted into the pocket part 80. In other words, a lock device (60) is disposed in a locked state in which an open state of the side wall boards (20) is locked.

10 Claims, 28 Drawing Sheets

FOLDABLE STORAGE BOX

RELATED APPLICATIONS

The present application is National Phase of International Application No. PCT/JP2010/058897 filed May 26, 2010, and claims priority from Japanese Application No. 2009-129162, filed May 28, 2009.

TECHNOLOGICAL FIELD

The present invention relates to a foldable storage box that folds up so as not to take up space.

BACKGROUND TECHNOLOGY

A storage apparatus (storage box) disclosed in Patent Document 1 (Japanese Unexamined Patent Publication No. 2008-87625) is stored compactly on a side surface of a luggage compartment of a vehicle by folding a pair of side wall parts and a bottom wall part configuring the storage apparatus (storage box) to become in a stored state.

DISCLOSURE OF THE INVENTION

Problems to be Solved by the Invention

However, according to the conventional configuration, there is no function for holding an open state (in-use state) when changing from the folded state (stored state) to this open state. It can therefore be imagined that the storage box may become folded unintentionally when an external force is applied unexpectedly.

Also, in order to hold this open state, it can be imagined that the user may install some kind of fixing member to hold the open state after opening the storage box. However, effort is required for installation of this fixing member.

In consideration of the abovementioned circumstances, an object of the present invention is to easily hold the open state.

Means for Solving the Problems

A foldable storage box of one aspect of the present invention includes: a rectangular base board; an opposing board opposing against the base board; a pair of side wall boards connected between a side edge of the base board and a side edge of the opposing board, so as to move the base board and the opposing board closer when in a folded state being folded, and to become in a open state from the folded state when the opposing board is moved away from the base board, said pair of side wall boards surrounding four sides together with the base board and the opposing board in this open state; a bottom board disposed in a stored state being overlaid with the base board and the opposing board when in the folded state of the side wall boards, and axially supported to rotate freely on the base board or the opposing board, so as to rotate from the stored state and move to an open state to configure a bottom part surrounded on four sides by the pair of side wall boards, the base board, and the opposing board, when the opposing board is moved away from the base board and the side wall boards are put into the open state from the folded state; and a lock unit for locking the side wall boards in the open state when the bottom board is transitioned to the open state from the stored state.

According to the abovementioned configuration, when using the foldable storage box, the opposing board is moved away from the base board and the pair of side wall boards connected between the side edge of the base board and the side edge of the opposing board into the open state from the folded state. Four sides are thereby surrounded by the pair of side wall boards, the base board, and the opposing board.

Also, the opposing board is moved away from the base board and the side wall boards are positioned to the open state from the folded state. The bottom board, which was disposed in the stored state to be overlaid with the base board and the opposing board, thereby rotate from the stored state and are changed to the open state to configure a bottom part surrounded on four sides by the pair of side wall boards, the base board, and the opposing board.

Furthermore, the lock unit locks the side wall boards in the open state when the bottom board is transitioned to the open state from the stored state.

The lock unit thus locks the side wall boards in the open state when the bottom board is transitioned to the open state from the stored state. The open state of the side wall boards can therefore be easily held.

In the abovementioned aspect, the lock unit unlocks the lock of the side wall boards being locked in the open state, when the bottom board is transitioned to the stored state from the open state.

According to the abovementioned configuration, the bottom board is transitioned to the stored state from the open state when the foldable storage box is folded. The lock unit thereby unlocks the lock of the side wall boards being locked in the open state.

The lock of the side wall boards being locked in the open state can thus be easily unlocked by just moving the bottom board to the stored state from the open state.

In the abovementioned aspect, a side wall urging member for urging the side wall boards is provided to become in the folded state.

According to the abovementioned configuration, the side wall urging member urges the side wall boards to become in the folded state. The side wall boards can therefore be easily transitioned to the folded state from the open state when in the state in which the lock of the side wall boards by the lock unit is unlocked.

In the abovementioned aspect, the lock unit includes: a pressing part provided on the rotating bottom board; and a lock device provided on the side wall boards, to be pressed by the pressing part to lock the side wall boards in the open state or to unlock the lock from the open state.

According to the abovementioned configuration, the pressing part provided on the bottom board locks the side wall boards in the open state or unlocks this lock, by pressing the lock device provided on the side wall boards.

The side wall boards can thus be locked in the open state or this lock can be unlocked with a simple configuration.

In the abovementioned aspect, a bottom board urging member is provided for urging the bottom board to the open state.

According to the abovementioned configuration, the operating force for the user to transition the bottom board to the open state from the stored state can be lightened because the bottom board urging member urges the bottom board to the open state.

The operating force for the user to transition the bottom board to the open state from the stored state can thus be lightened by providing the bottom board urging member.

In the abovementioned aspect a transition allowing member is provided for allowing transition of the bottom board from the stored state to the open state or from the open state to the stored state when the lock device is in either state, the locked state in which the side wall boards are locked in the open state, or the unlocked state in which the lock is unlocked.

According to the abovementioned configuration, the transition allowing member allows transition of the bottom board from the stored state to the open state or from the open state to the stored state when the lock device is in either state, the locked state in which the side wall boards are locked in the open state, or the unlocked state in which this lock is unlocked.

The bottom board can therefore be transitioned from the stored state to the open state or from the open state to the stored state when the lock device gets transitioned to the locked state or the unlocked state without being pressed by the pressing part.

A foldable storage box of a second aspect of the present invention includes: a rectangular base board; an opposing board provided opposite the base board; a pair of side wall boards connected between a side edge of the base board and a side edge of the opposing board, so as to move the base board and the opposing board closer when in a folded state being folded, and to become in a open state from the folded state when the opposing board is moved away from the base board, said pair of side wall boards surrounding four sides together with the base board and the opposing board in this open state; a bottom board disposed in a stored state when being overlaid with the base board and the opposing board in the folded state of the side wall boards, and axially supported to rotate freely on the base board or the opposing board, said bottom board transitioning from the stored state to the open state by moving rotatably to configure a bottom part surrounded on four sides by the pair of side wall boards, the base board, and the opposing board, when the opposing board is moved away from the base board and the side wall boards are put into the open state from the folded state; and a separating member for moving the opposing board away from the base board in a manner so that lengths of diagonal lines on the bottom part surrounded on four sides by the pair of side wall boards, the base board, and the opposing board become equal, when the opposing board is moved away from the base board and the pair of side wall boards is put into the open state from the folded state.

According to the abovementioned configuration, when using the foldable storage box, the opposing board is moved away from the base board and the pair of side wall boards connected between the side edge of the base board and the side edge of the opposing board is put into the open state from the folded state. Four sides are thereby surrounded by the pair of side wall boards, the base board, and the opposing board.

Also, the opposing board is moved away from the base board and the side wall boards are put into the open state from the folded state. The bottom board, which was disposed in the stored state being overlaid with the base board and the opposing board, thereby rotates from the stored state and transitions to the open state to configure a bottom part surrounded on four sides by the pair of side wall boards, the base board, and the opposing board.

Furthermore, the separating member moves the opposing board away from the base board in a manner so that the lengths of diagonal lines on the bottom part surrounded on four sides by the pair of side wall boards, the base board, and the opposing board become equal.

Warping of the foldable storage box can thus be prevented by making the lengths of the diagonal lines on the bottom part equal.

Effect of the Invention

According to the present invention, the open state can be easily held.

BEST MODE FOR CARRYING OUT THE INVENTION

One example of a foldable storage box according to a first embodiment of the present invention is described in accordance with FIGS. 1 to 18.

(Overall Configuration)

Figure 1:
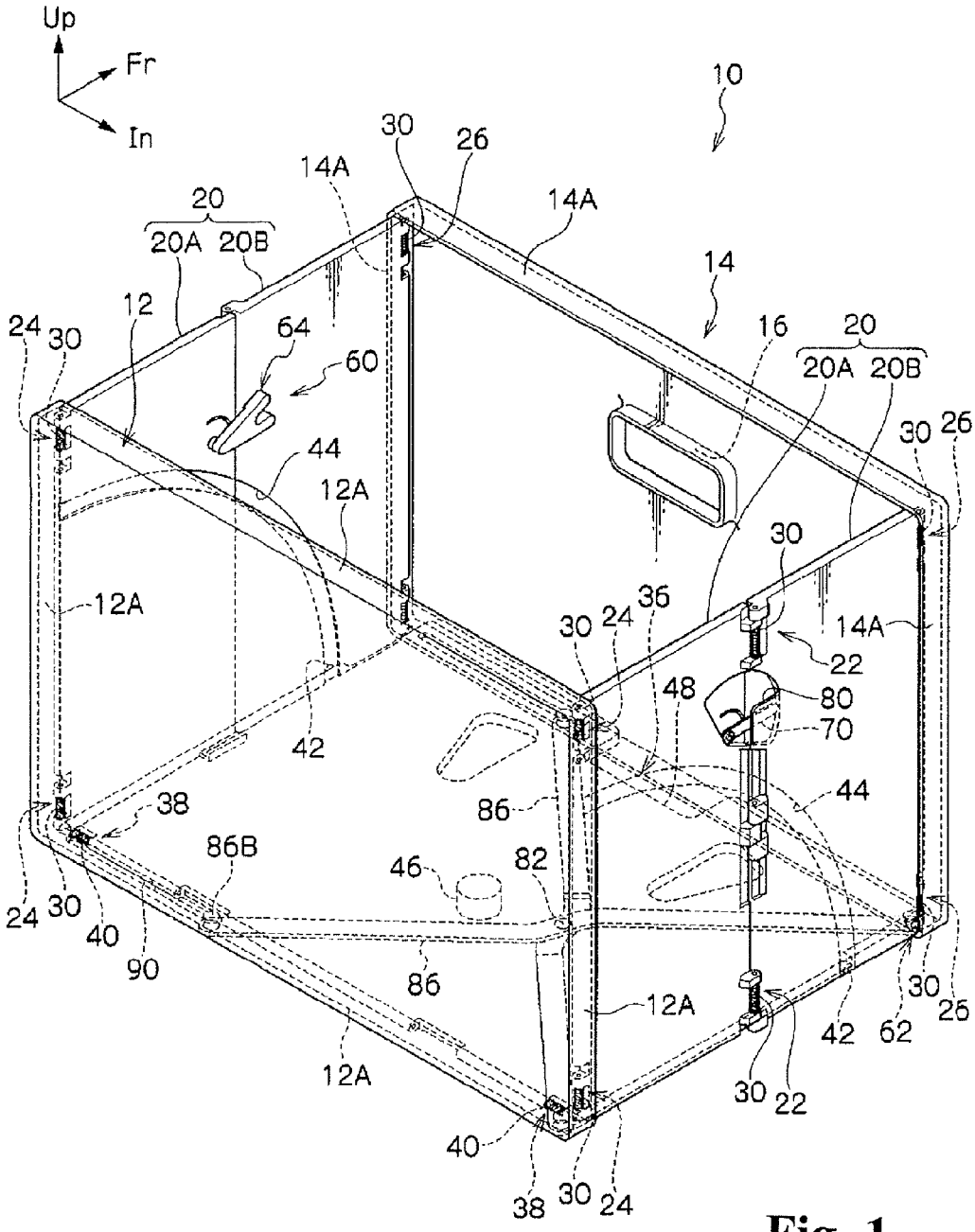
FIG. 1 is a perspective view illustrating the foldable storage box according to the first embodiment of the present invention.

The foldable storage box 10 according to the first embodiment includes a rectangular base board 12, as illustrated in FIG. 1. This base board 12 is molded with a resin material. Also, flanges 12A for ensuring rigidity of the base board 12 are integrally molded so as to be placed standing on the four edge parts of the base board 12.

Furthermore, an opposing board 14 having the same external shape as the base board 12 is provided so as to correspond with the base board 12. This opposing board 14 is formed with a resin material. Also, flanges 14A for ensuring rigidity of the opposing board 14 are integrally molded so as to be placed standing facing the base board 12 on the four edge parts of the opposing board 14. Also, a handle part 16 capable of being gripped by a user is provided on the opposing board 14.

Furthermore, a pair of side wall boards 20 molded with a resin material is provided, being connected between a flange 12A on a side edge of the base board 12 and a flange 14A on a side edge of the opposing board 14. The side wall boards 20 move the base board 12 and the opposing board 14 closer when in the folded state being folded up (see FIG. 2). Furthermore, the side wall boards 20 become in a open state from the folded state when the handle part 16 of the opposing board 14 is gripped and the opposing board 14 is moved away from the base board 12. Also, the side wall boards 20 surround the four sides together with the base board 12 and the opposing board 14 in this open state.

Specifically, the side wall boards 20 are divided into a first side wall board 20A on the side of the base board 12 and a second side wall board 20B on the side of the opposing board 14 so that the dividing line extends in a vertical direction (a direction orthogonal to the direction in which the opposing board 14 moves away from the base board 12). Also, the first side wall board 20A and the second side wall board 20B are supported to be capable of rotation by an axial support part 22 having the axial direction in the vertical direction.

Also, the first side wall board 20A and the flange 12A of the base board 12 are supported to be capable of rotation by an axial support part 24 having the axial direction in the vertical direction. Also, the second side wall board 20B and the flange 14A of the opposing board 14 are supported to be capable of rotation by an axial support part 26 having the axial direction in the vertical direction.

Furthermore, torsion coil springs 30, being side wall urging members for urging the first side wall board 20A and the second side wall board 20B to be folded so that the side wall boards 20 become in a folded state (see FIG. 2), are provided on the axial support part 22, the axial support part 24, and the axial support part 26.

Also, a magnetic latch (not illustrated) for holding the base board 12 and the opposing board 14 in the state being moved closer with the side wall boards 20 being in the folded state, so that the foldable storage box 10 is folded, is provided on at least one of the base board 12 and the opposing board 14.

Figure 2:
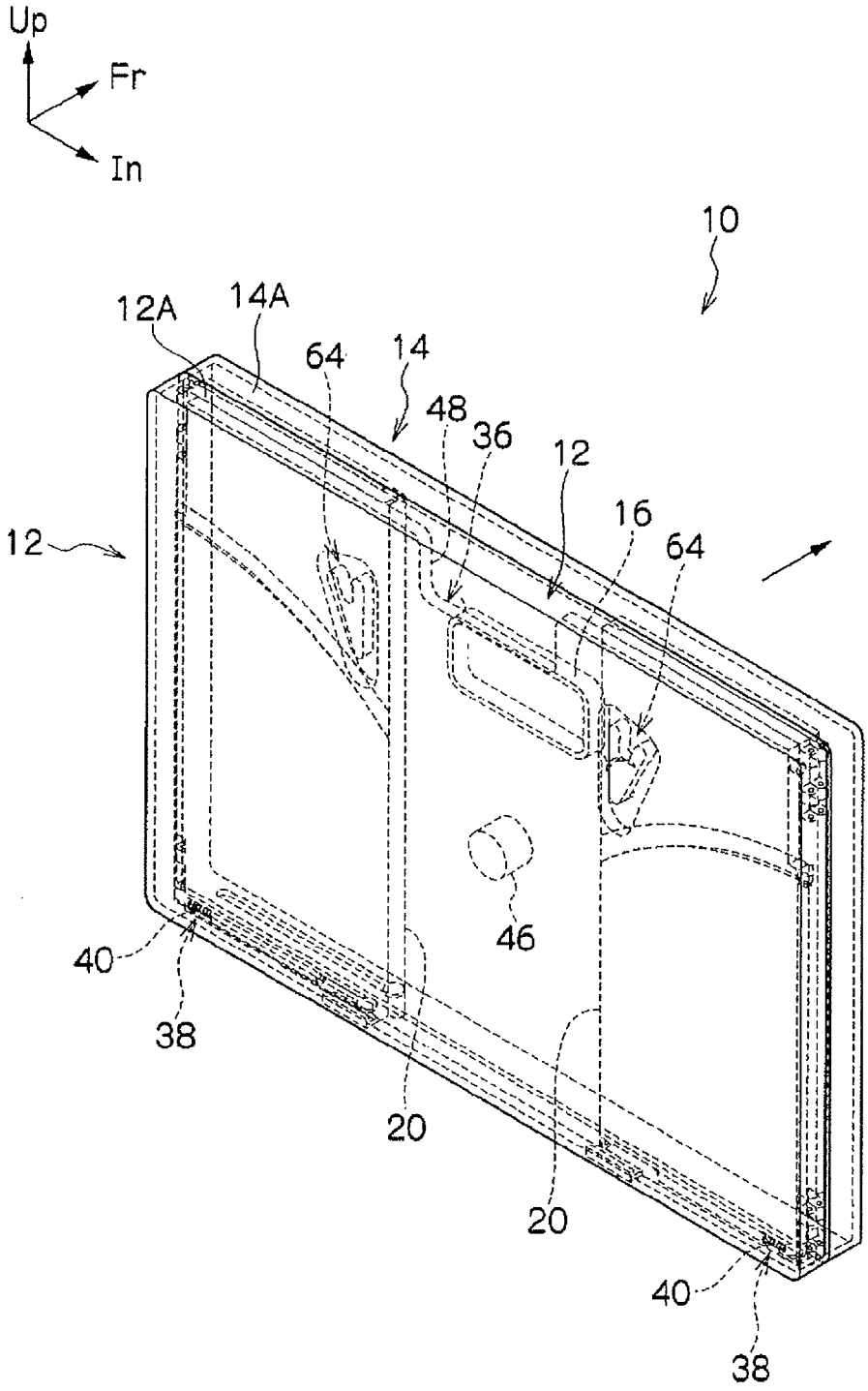
FIG. 2 is a perspective view illustrating the foldable storage box according to the first embodiment of the present invention.

Furthermore, there is provided a rectangular bottom board 36 disposed in a stored state being overlaid with the base board 12 and the opposing board 14 when in the folded state of the side wall boards 20, as illustrated in FIG. 2. The bottom board 36 is supported to be capable of rotation on a flange 12A provided on the lower edge (the lower side illustrated in FIG. 2) of the base board 12, by an axial support part 38 having the axial direction in the long direction of the flange 12A on the lower edge.

Also, a torsion coil spring 40 as a bottom board urging member for urging the bottom board 36 to an open state is provided on the axial support part 38. The bottom board 36 can thereby be easily transitioned to the open state from the stored state. Also, a recessed part 48 for allowing the user to insert a hand is provided as a recessed form in one area of an edge part of the bottom board 36.

By this configuration, the opposing board 14 is moved away from the base board 12, and the side wall boards 20, urged to become in the folded state by the torsion coil springs 30, are put into the open state. The bottom board 36 thereby rotates from the stored state and moves to the open state by the operating force of the user and the urging force of the torsion coil spring 40. Also, the bottom board 36 configures a bottom part surrounded on four sides by the pair of side wall boards 20, the base board 12, and the opposing board 14.

Furthermore, a cylindrical support part 46 (see FIG. 8) for supporting the bottom board 36 in the open state with a leading end part contacting a mounting surface is integrally provided in the center part of the bottom board 36, as illustrated in FIG. 1. Also, a round-columnar guide pin 42 placed projecting toward the side wall boards 20 is provided on a side surface of the bottom board 36. Also, an arc-form guide groove 44 for guiding the guide pin 42 moving between the folded state and the open state is provided on the side wall boards 20.

By this configuration, the guide groove 44 on the side wall boards 20 guides the guide pin 42 when the bottom board 36 is moved toward the open state from the stored state. Also, when the guide groove 44 guides the guide pin 42, the bottom surface of the guide groove 44 is pressed by the guide pin 42, and the side wall boards 20 transition to the open state from the folded state.

(Configuration of Main Parts)

A lock unit 58, for locking side wall boards 20 in the open state when the bottom board 36 is transitioned to the open state (see FIG. 1) from the stored state (see FIG. 2), and for unlocking the lock of the side wall boards 20 locked in the open state when the bottom board 36 is transitioned to the stored state from the open state, and the like, is next described.

Figure 16A:
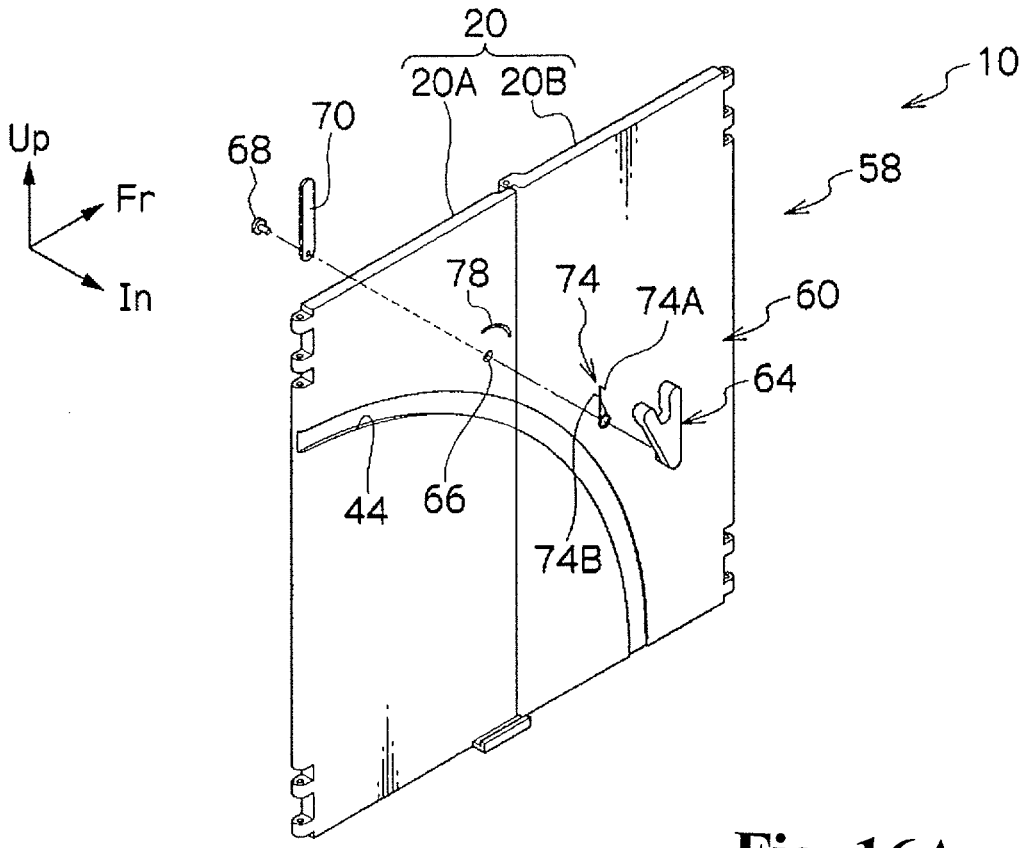
FIG. 16A is an exploded perspective view illustrating the side wall boards used in the foldable storage box according to the first embodiment of the present invention.
Figure 16B:
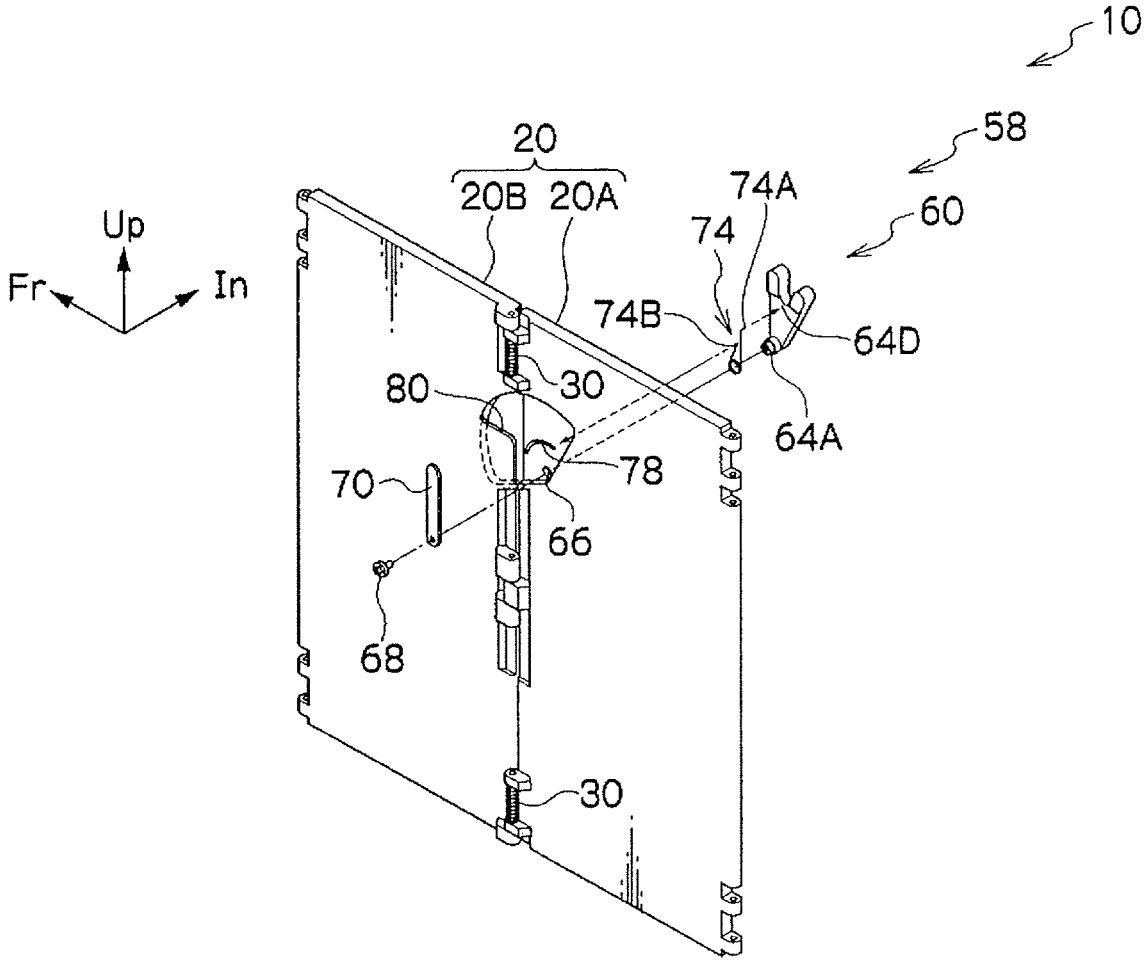
FIG. 16B is an exploded perspective view illustrating the side wall boards used in the foldable storage box according to the first embodiment of the present invention.
Figure 17A:
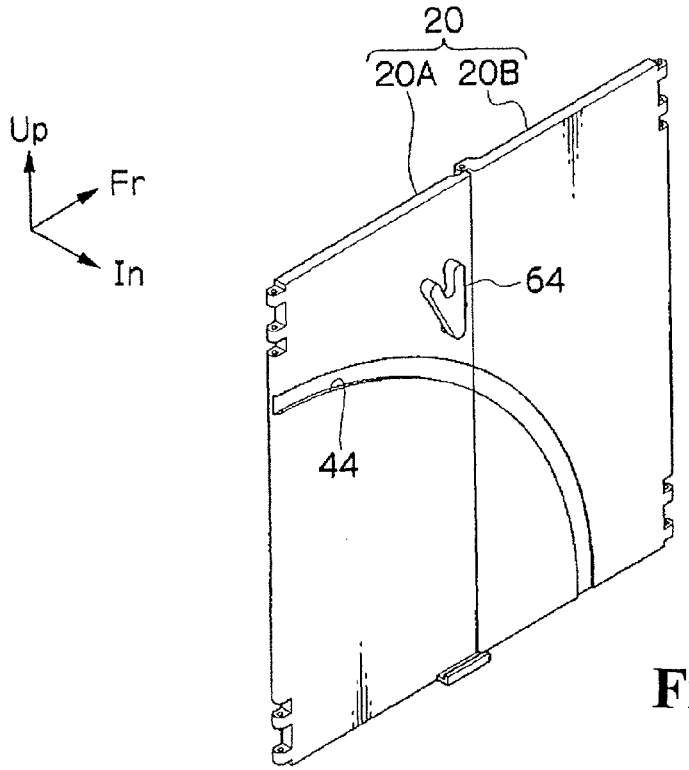
FIG. 17A is a perspective view illustrating the side wall boards used in the foldable storage box according to the first embodiment of the present invention.
Figure 17B:
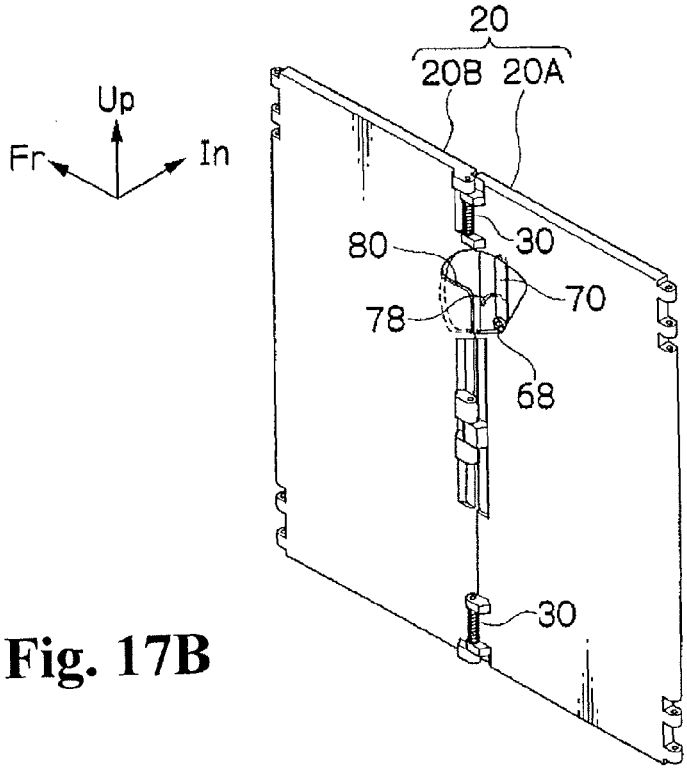
FIG. 17B is a perspective view illustrating the side wall boards used in the foldable storage box according to the first embodiment of the present invention.

The lock unit 58 includes a round-columnar pressing part 62 (see FIG. 4) provided on a side surface of the bottom board 36 and placed projecting toward the side wall boards 20, and a lock device 60 provided on the side wall boards 20, to be pressed by the pressing part 62 to lock the side wall boards 20 in the open state or to unlock the lock from the open state, as illustrated in FIGS. 16A and 16B.

The lock device 60 includes a roughly V-form rotating member 64 provided on the inner side (the side of the storage area of the foldable storage box 10) of the side wall boards 20, to be pressed to rotate by the pressing part 62 on the bottom board 36 (see FIG. 1) transitioning between the open state and the stored state.

A round-columnar rotating shaft 64A is integrally formed on a base end part of this rotating member 64. Also, the rotating member 64 is configured to be made capable of rotation by inserting this rotating shaft 64A into a through-hole 66 provided on the first side wall board 20A.

Furthermore, a rod-form lock member 70 fixed by a screws 68 to the rotating shaft 64A is provided on the outer side of the side wall boards 20. This lock member 70 rotates together with the rotating member 64 by way of the rotating shaft 64A.

Also, a torsion coil spring 74 is disposed on the rotating shaft 64A. Also, one end 74A of this torsion coil spring 74 is turned up and inserted into a round hole 64D formed on the rotating member 64. As opposed to this, the other end 74B of the torsion coil spring 74 is turned up, inserted into an arc-form arc hole 78 centered on the through-hole 66 formed on the first side wall board 20A, and made capable of moving inside the arc hole 78.

Figure 11A:
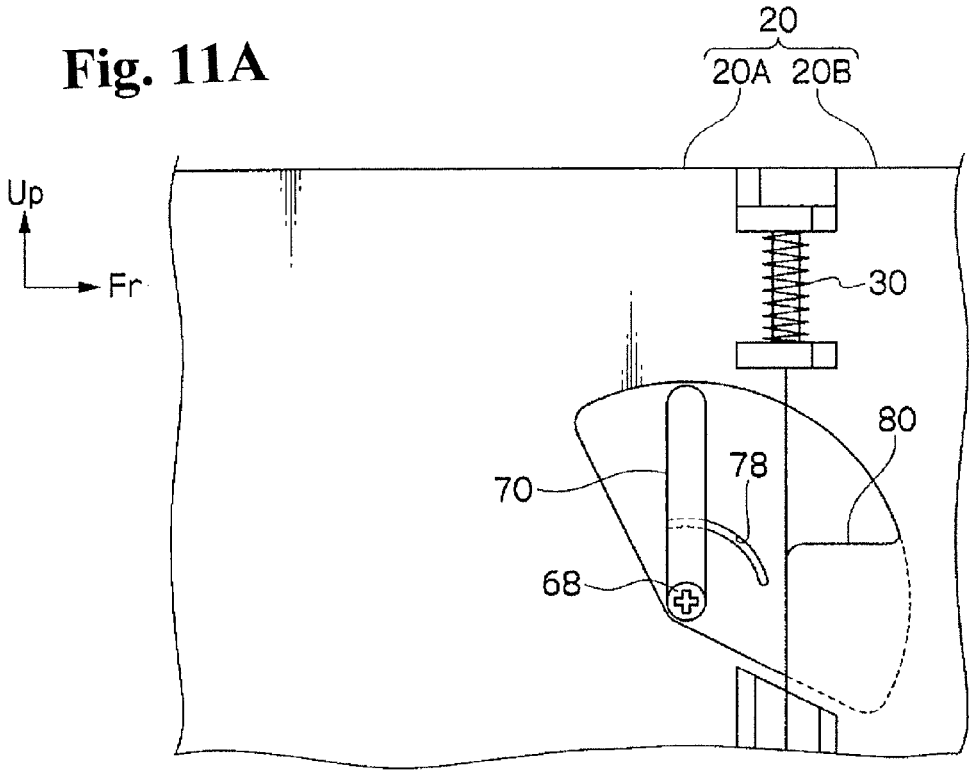
FIG. 11A is a side view illustrating the lock device used in the foldable storage box according to the first embodiment of the present invention.
Figure 11B:
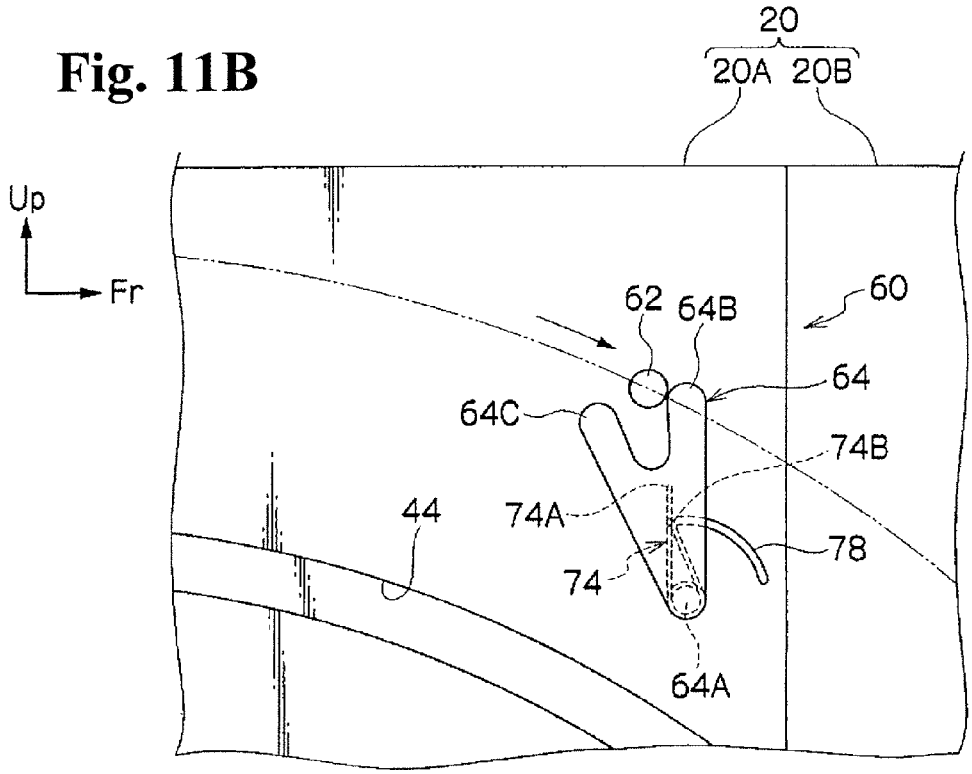
FIG. 11B is a side view illustrating the lock device used in the foldable storage box according to the first embodiment of the present invention.

The other end 74B of the torsion coil spring 74 is disposed on one end part of the arc hole 78 when the opening of the V form of the rotating member 64 is oriented upward, as illustrated in FIG. 11B. Also, the rod-form lock member 70 is provided so as to span in the vertical direction, and is disposed not spanning between the first side wall board 20A and the second side wall board 20B, as illustrated in FIG. 11A. In other words, when the opening of the V form of the rotating member 64 is oriented upward, the lock device 60 comes to be disposed in the unlocked state in which the lock of the open state of the side wall boards 20 is unlocked, as illustrated in FIGS. 11A, 11B, 17A, and 17B.

As opposed to this, the configuration is such that the pressing part 62 formed on the bottom board 36 presses one projecting part 64B of the V form of the rotating member 64 when the bottom board 36 (see FIG. 4) in the stored state is moved to the open state, as illustrated in FIG. 11B.

Figure 12A:
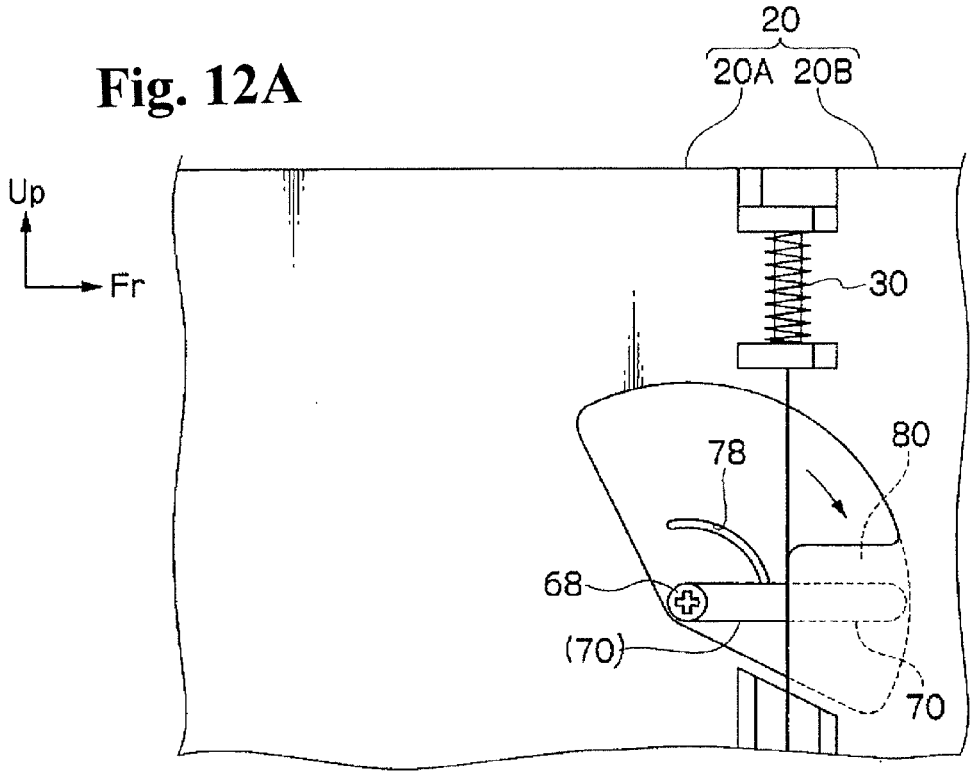
FIG. 12A is a side view illustrating the lock device used in the foldable storage box according to the first embodiment of the present invention.
Figure 12B:
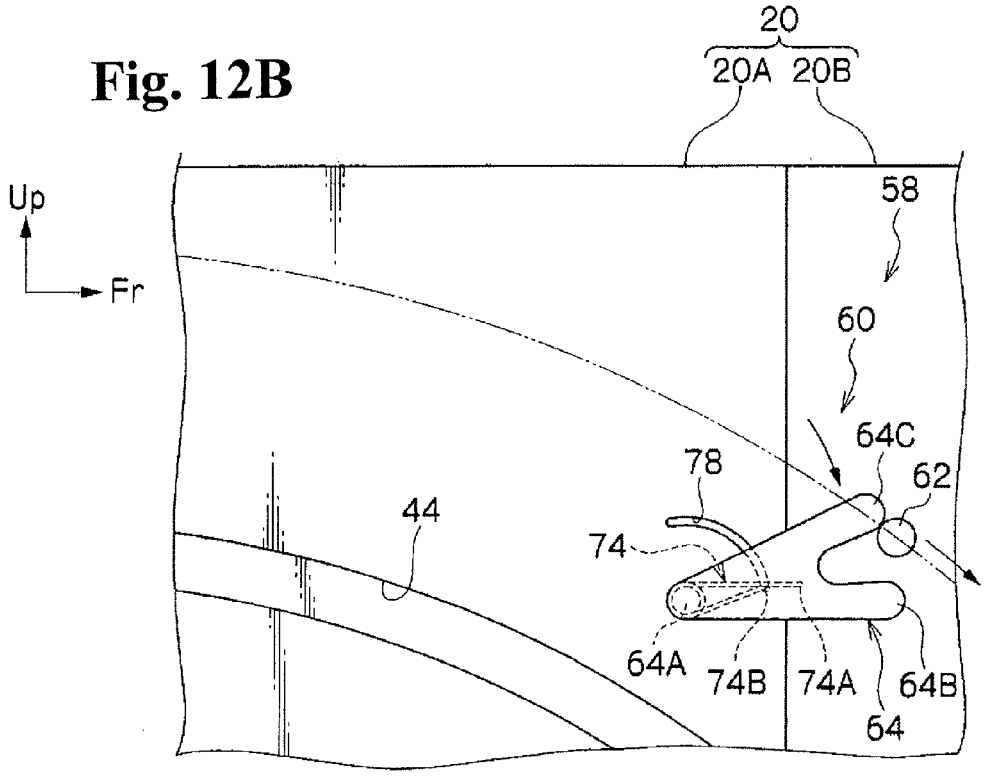
FIG. 12B is a side view illustrating the lock device used in the foldable storage box according to the first embodiment of the present invention.
Figure 18A:
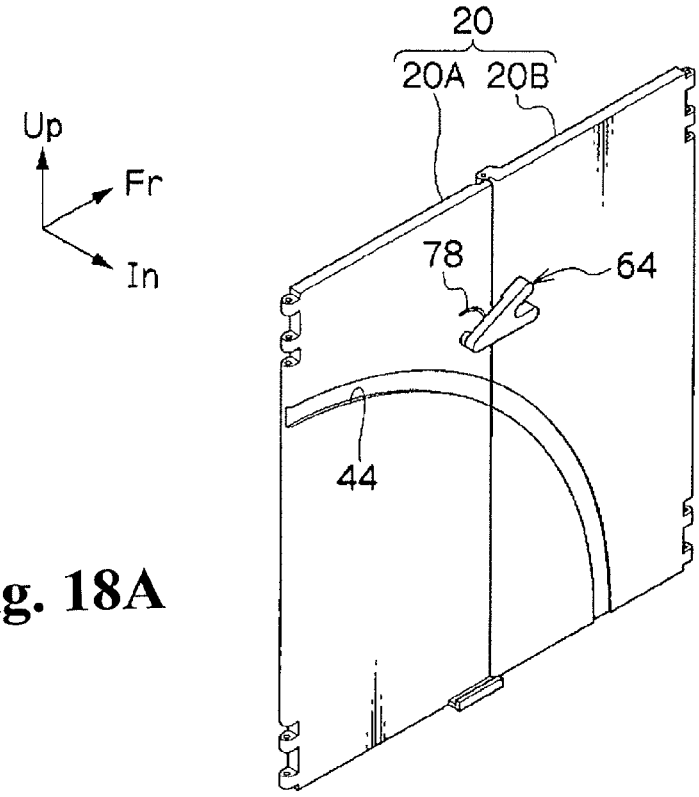
FIG. 18A is a perspective view illustrating the side wall boards used in the foldable storage box according to the first embodiment of the present invention.

Also, the rotating member 64 rotates when the rotating member 64 is pressed, and the other end 74B of the torsion coil spring 74 moves to the other end part of the arc hole 78, as illustrated in FIGS. 12B and 18A. Also, the rotating member 64 stops with the opening of the V form of the rotating member 64 facing the side.

Figure 18B:
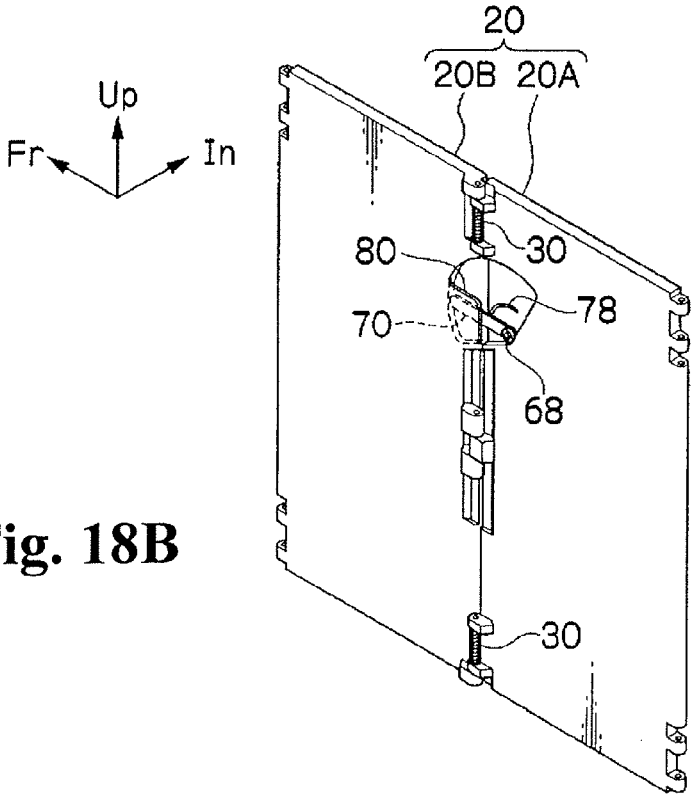
FIG. 18B is a perspective view illustrating the side wall boards used in the foldable storage box according to the first embodiment of the present invention.

The rod-form lock member. 70 is disposed so as to extend in the horizontal direction when in the stopped state of the rotating member 64, as illustrated in FIGS. 12A and 18B. Also, a leading end part of the lock member 70 is inserted into a recessed pocket part 80 formed on the second side wall board 20B. The configuration is such that the lock member 70 in this state is disposed so as to span between the first side wall board 20A and the second side wall board 20B. In other words, when the opening of the V form of the rotating member 64 faces the side, the lock device 60 is disposed in the locked state in which the open state of the side wall boards 20 is locked.

Figure 13A:
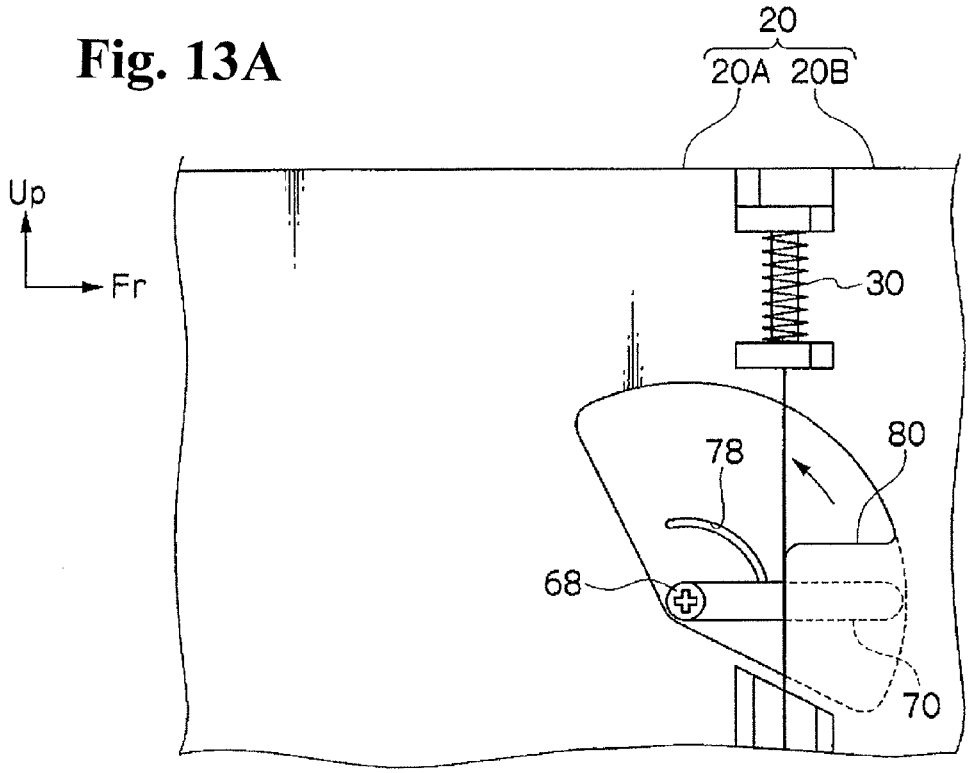
FIG. 13A is a side view illustrating the lock device used in the foldable storage box according to the first embodiment of the present invention.
Figure 13B:
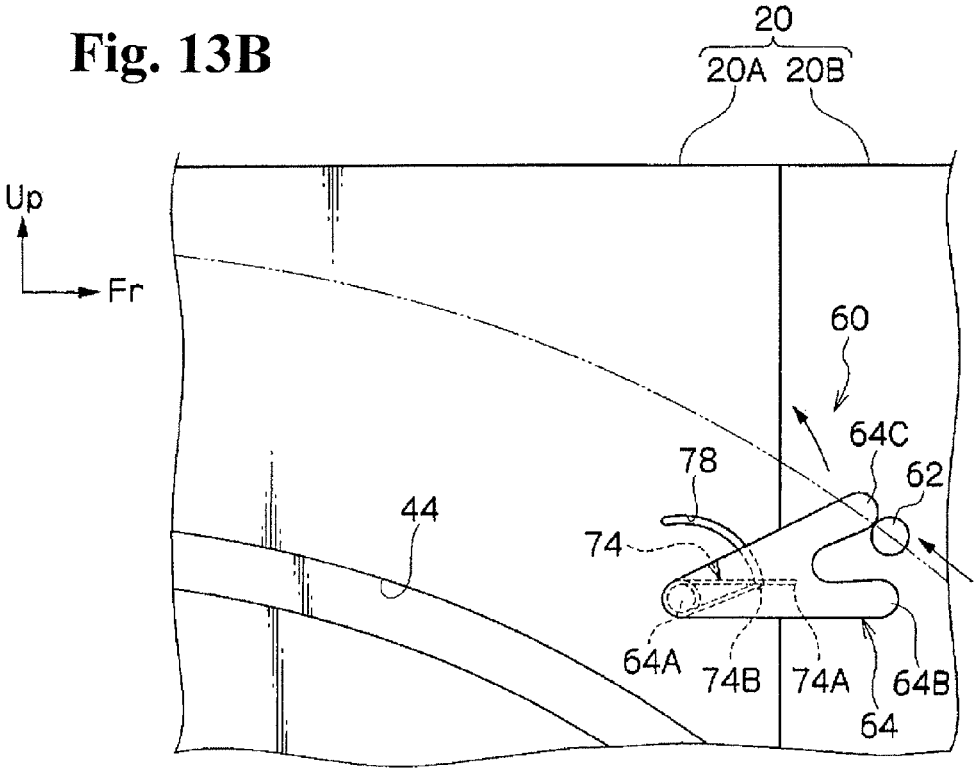
FIG. 13B is a side view illustrating the lock device used in the foldable storage box according to the first embodiment of the present invention.

Meanwhile, the bottom board 36 (see FIG. 4) in the open state is transitioned to the stored state, as illustrated in FIGS. 13A and 13B. The configuration is such that the pressing part 62 formed on the bottom board 36 thereby presses the other projecting part 64C of the V form of the rotating member 64. Also, the rotating member 64 and the lock member 70 rotate, and the other end 74B of the torsion coil spring 74 moves from the other end part of the arc hole 78 to the one end part, as illustrated in FIGS. 11A and 11B. Also, the rotating member 64 stops with the opening of the V form of the rotating member 64 facing upward. In other words, the lock device 60 is disposed in the unlocked state in which the lock of the open state of the side wall boards 20 is unlocked.

Figure 14A:
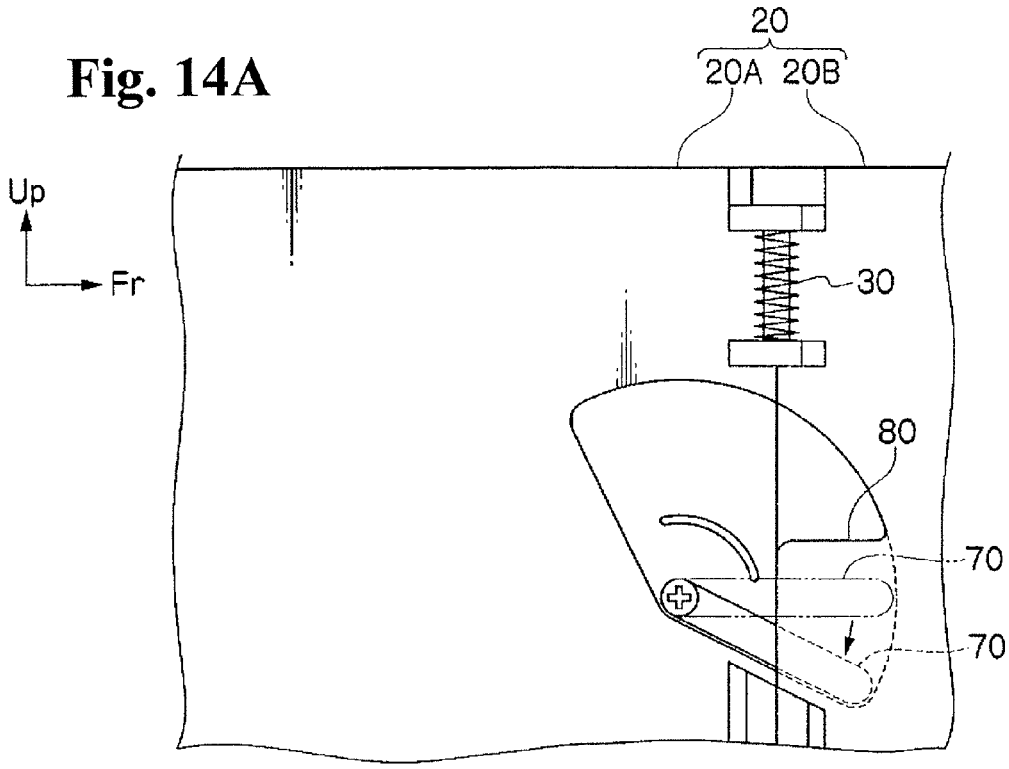
FIG. 14A is a side view illustrating the lock device used in the foldable storage box according to the first embodiment of the present invention.
Figure 14B:
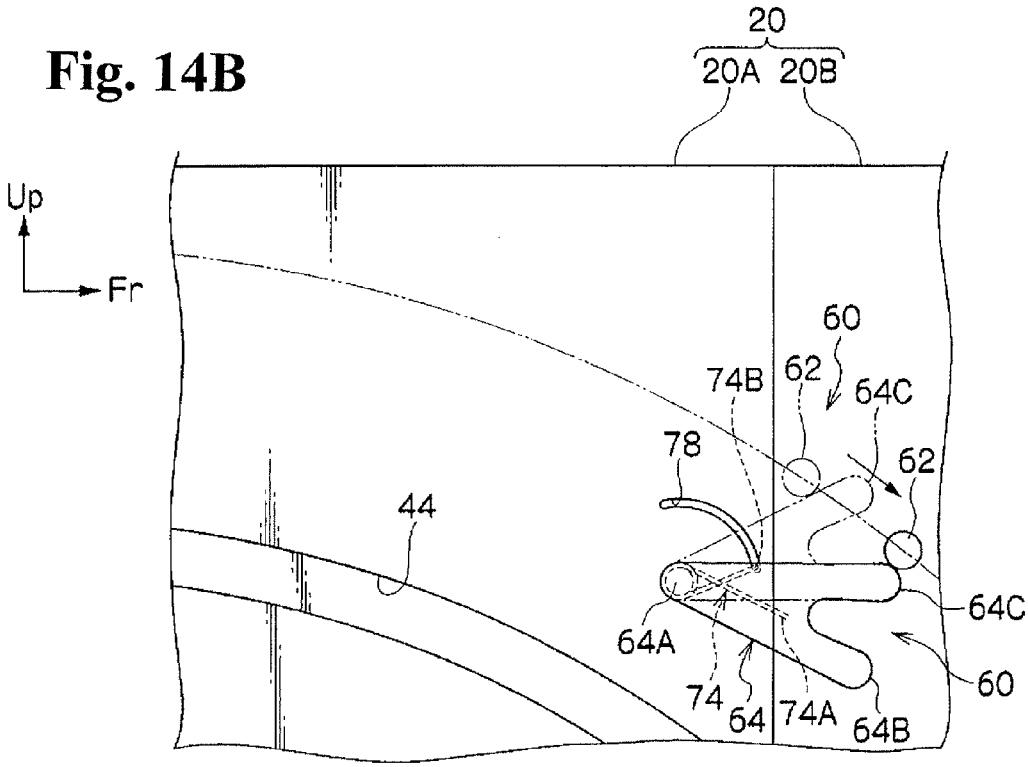
FIG. 14B is a side view illustrating the lock device used in the foldable storage box according to the first embodiment of the present invention.

As opposed to this, the bottom board 36 in the stored state (see FIG. 4) is moved to the open state in the case when the lock device 60 is disposed in the locked state despite the fact that the bottom board 36 is disposed in the stored state, as illustrated in FIGS. 14A and 14B. The configuration is such that the pressing part 62 formed on the bottom board 36 thereby presses the other projecting part 64C of the V form of the rotating member 64. The rotating member 64 subject to pressing of the projecting part 64C elastically deforms the torsion coil spring 64 and thereby rotates so as to withdraw from the track of movement. Also, the rotating member 64 is configured to allow movement of the pressing part 62. After passing the pressing part 62, the rotating member 64 returns to the locked state by the urging force of the torsion coil spring 74.

Figure 15A:
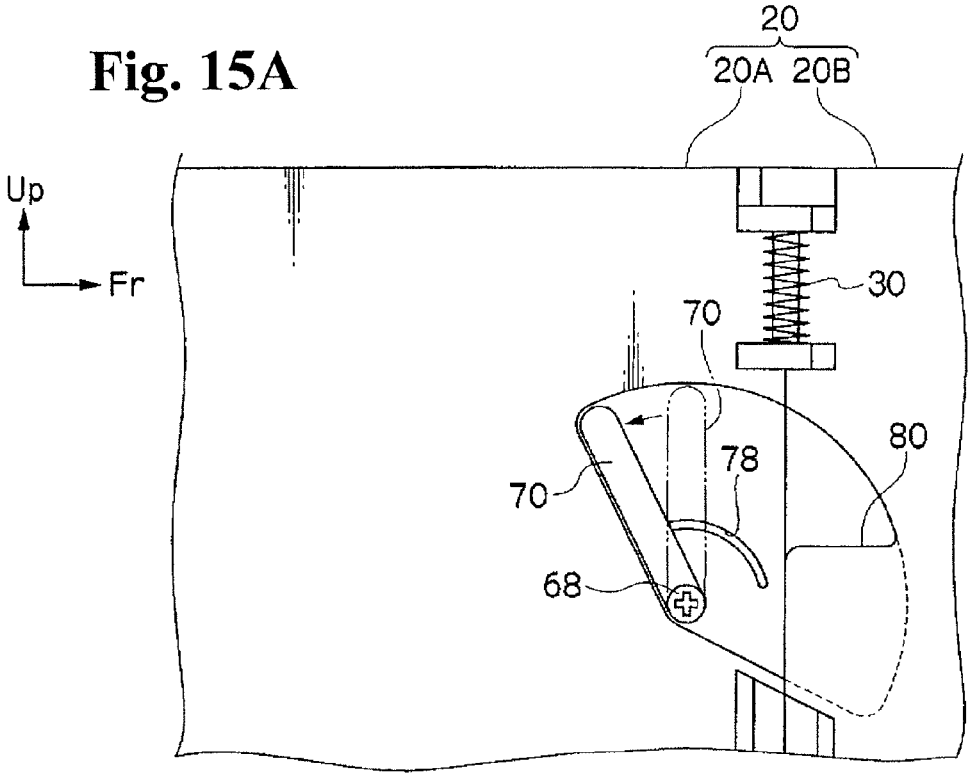
FIG. 15A is a side view illustrating the lock device used in the foldable storage box according to the first embodiment of the present invention.
Figure 15B:
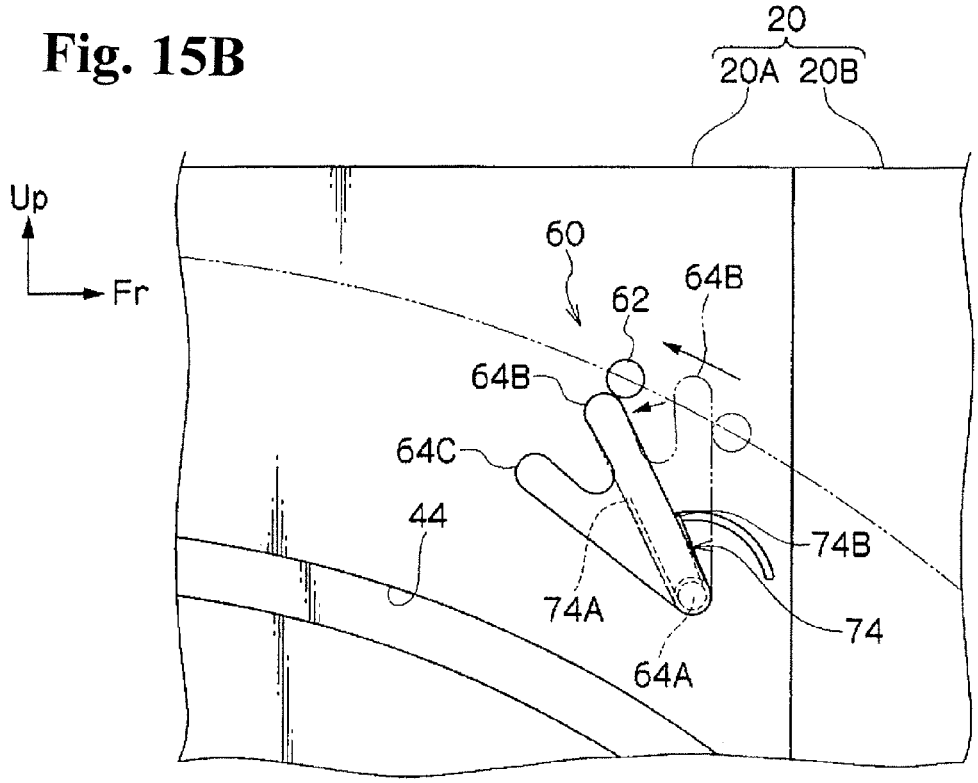
FIG. 15B is a side view illustrating the lock device used in the foldable storage box according to the first embodiment of the present invention.

Furthermore, the bottom board 36 (see FIG. 4) in the open state is transitioned to the stored state in the case when the lock device 60 is disposed in the unlocked state despite the fact that the bottom board 36 is disposed in the open state, as illustrated in FIGS. 15A and 15B. The configuration is such that the pressing part 62 formed on the bottom board 36 thereby presses the one projecting part 64B of the V form of the rotating member 64. The rotating member 64 subject to pressing of the projecting part 64B elastically deforms the torsion coil spring 64 and thereby rotates so as to withdraw from the track of movement. Also, the rotating member 64 is configured to allow movement of the pressing part 62. After passing the pressing part 62, the rotating member 64 returns to the locked state by the urging force of the torsion coil spring 74.

In other words, the torsion coil spring 74 serves as a transition allowing member for allowing transition of the bottom board 36 from the stored state to the open state or from the open state to the stored state when the lock device 60 is in either state, being the locked state in which the side wall boards 20 are locked in the open state, or the unlocked state in which this lock is unlocked.

Figure 6:
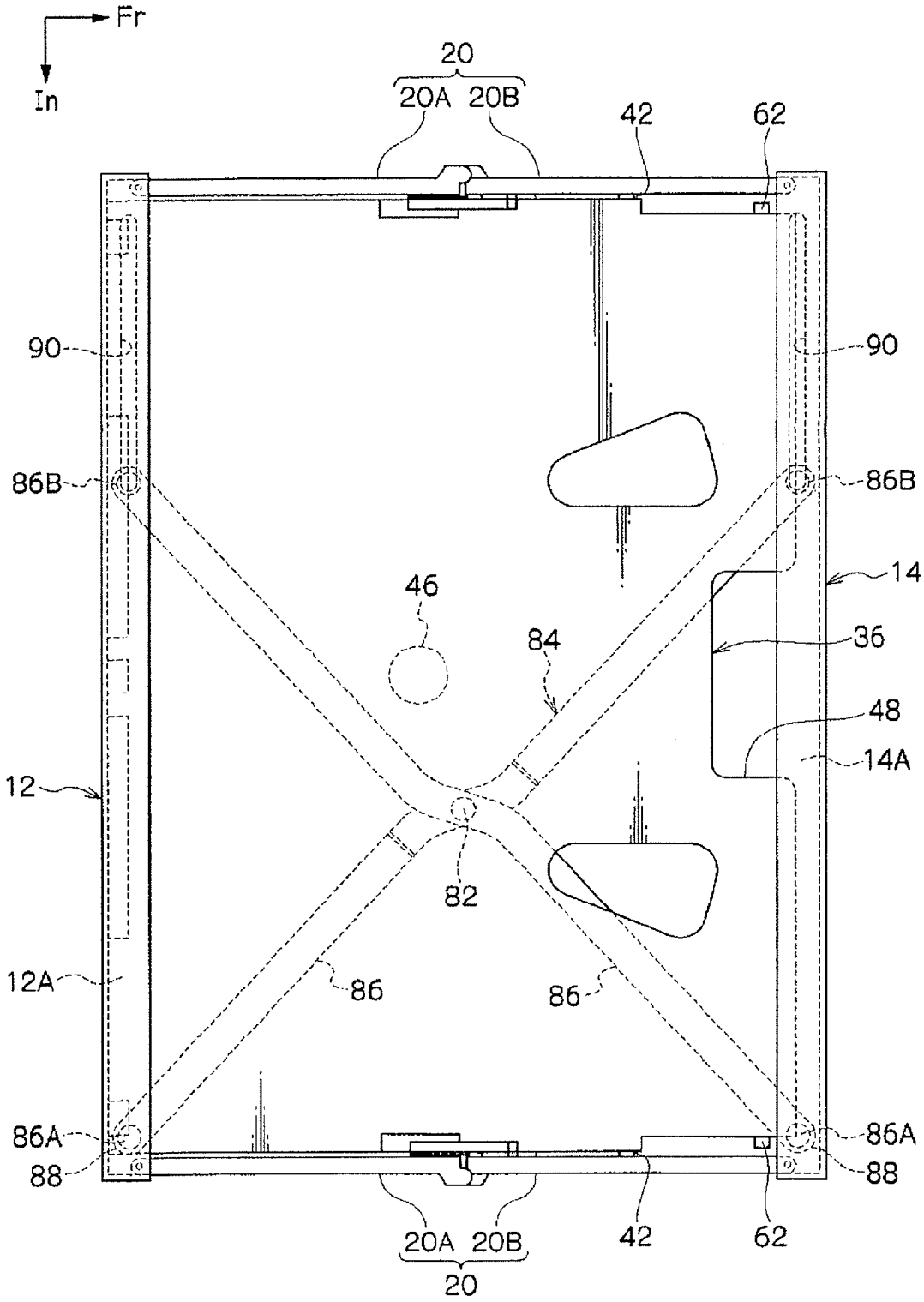
FIG. 6 is a bottom view illustrating the foldable storage box according to the first embodiment of the present invention.
Figure 7:
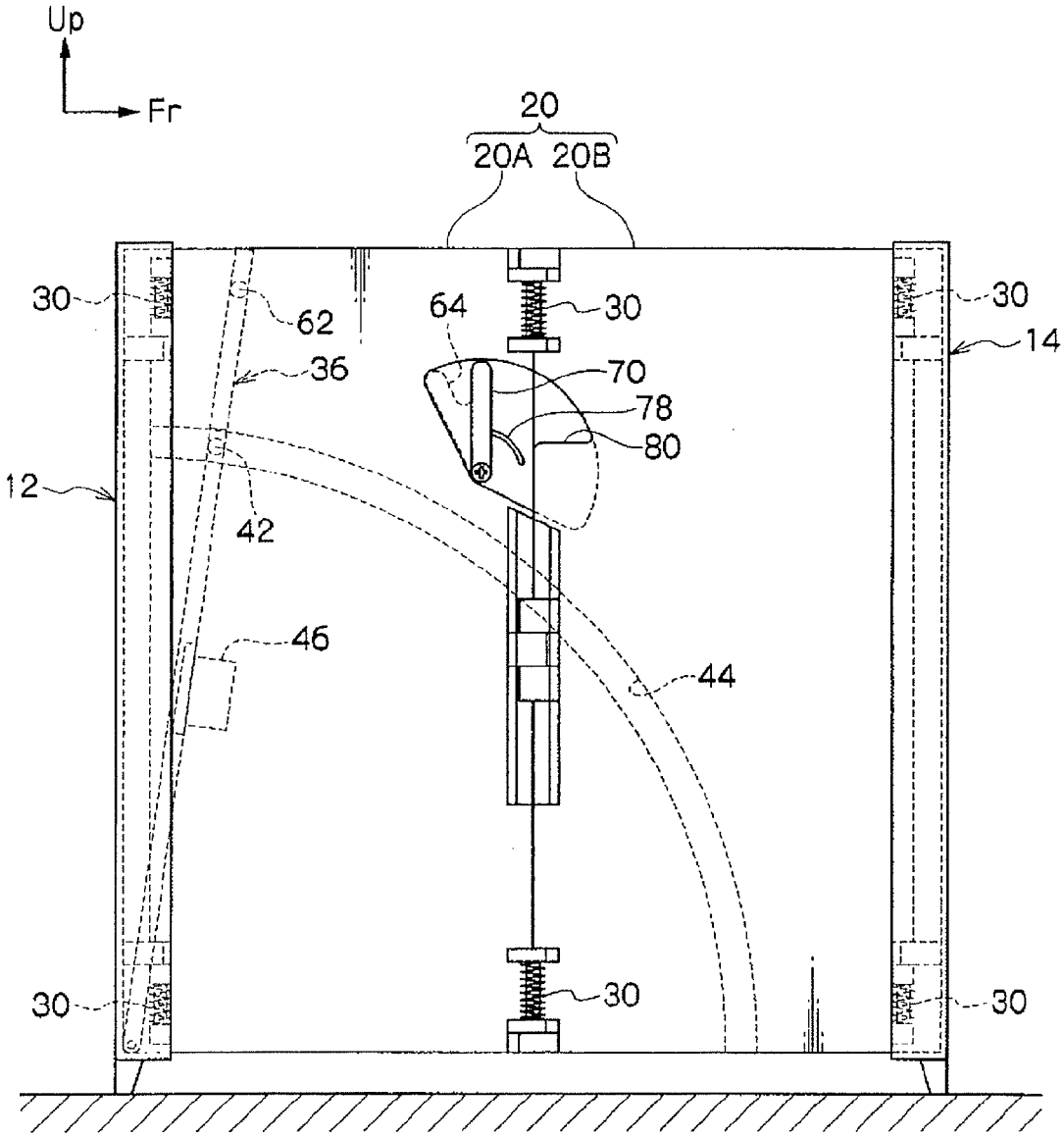
FIG. 7 is a side view illustrating the foldable storage box according to the first embodiment of the present invention.
Figure 8:
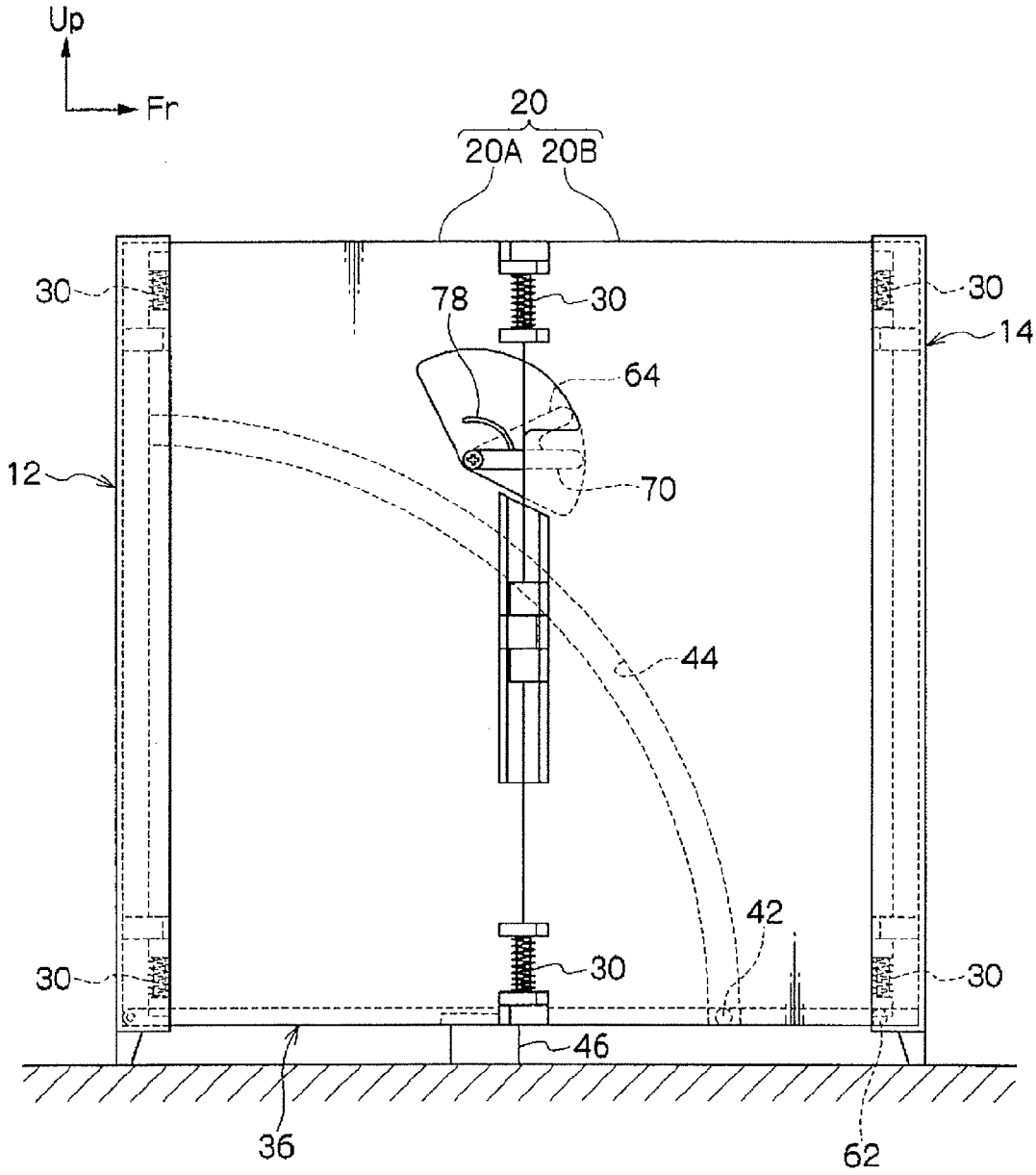
FIG. 8 is a side view illustrating the foldable storage box according to the first embodiment of the present invention.
Figure 9:
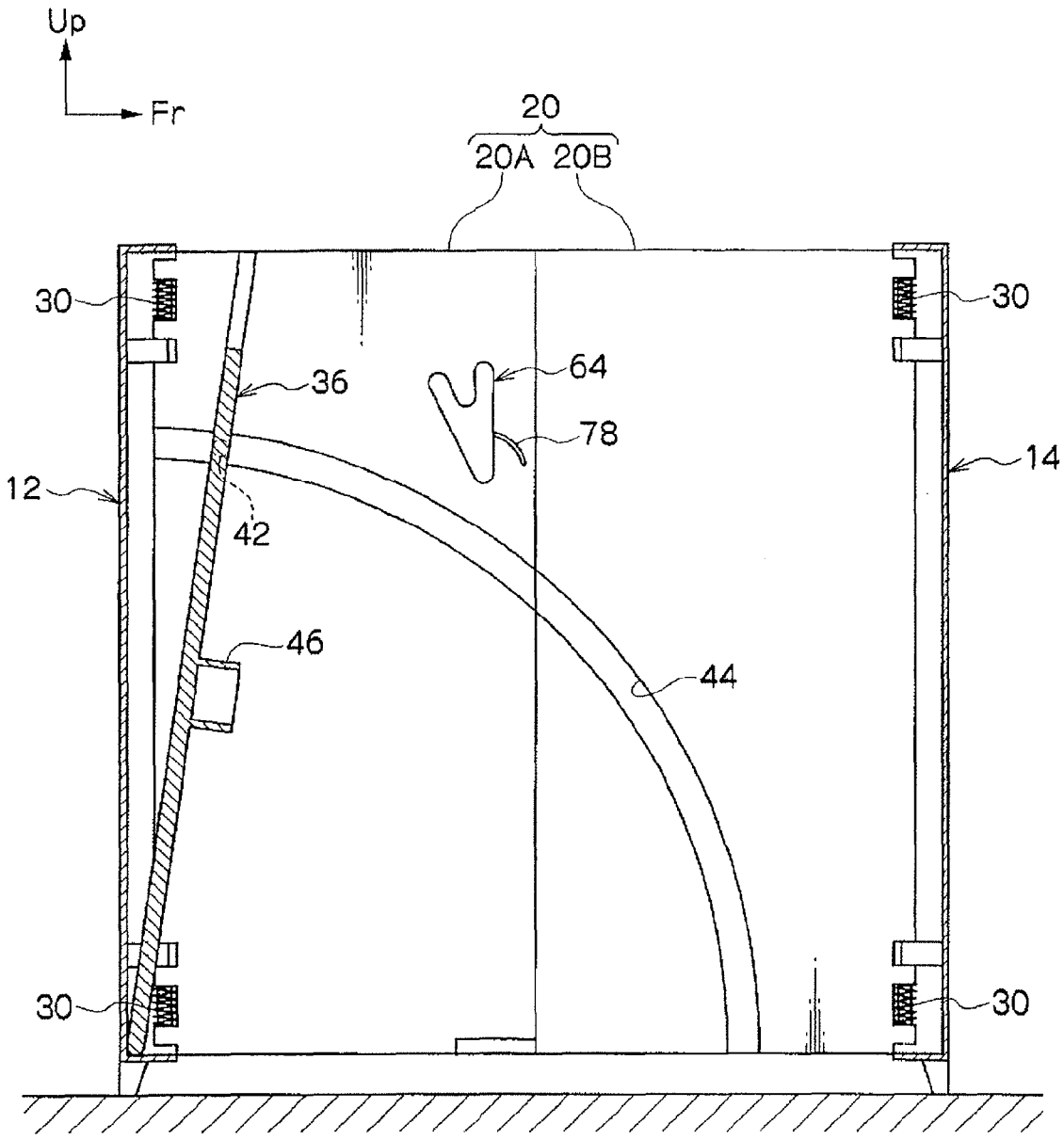
FIG. 9 is a cross-sectional view illustrating the foldable storage box according to the first embodiment of the present invention.
Figure 10:
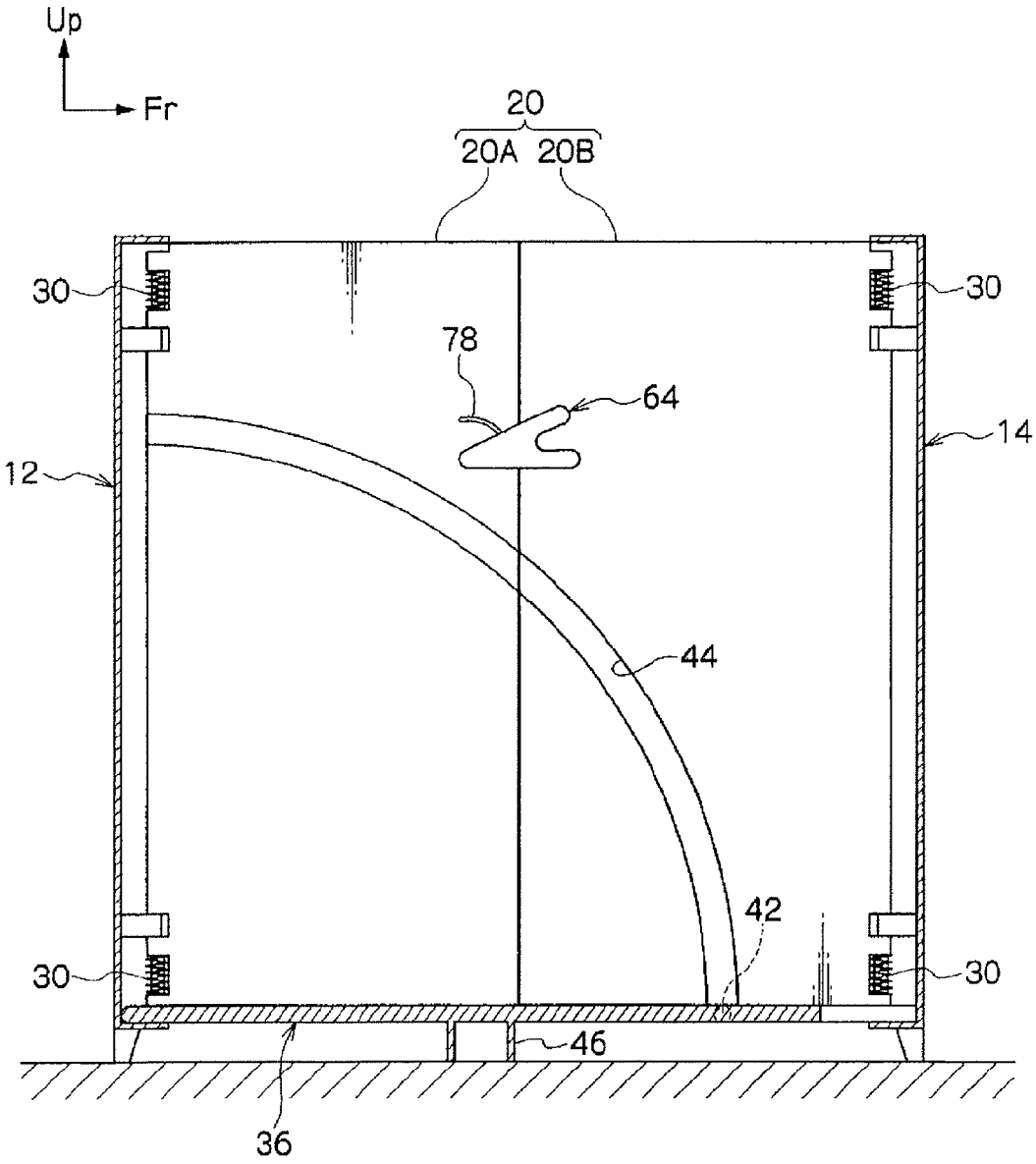
FIG. 10 is a cross-sectional view illustrating the foldable storage box according to the first embodiment of the present invention.

Meanwhile, there is included an X arm 84 as a separating member for moving the opposing board 14 away from the base board 12 in a manner so that lengths of diagonal lines on the bottom part surrounded on four sides by the pair of side wall boards 20, the base board 12, and the opposing board 14 become equal, as illustrated in FIGS. 1 and 6. Also, this X arm 84 is provided so as to span between the flange 12A provided on the lower edge of the base board 12 and the flange 14A provided on the lower edge of the opposing board 14.

Specifically, the X arm 84 includes a pair of arm members 86, and the pair of arm members 86 is supported by an axial support part 82 to be mutually capable of rotation.

Furthermore, each one end 86A of the pair of arm members 86 is provided respectively on the flange 12A and the flange 14A, and is supported to be capable of rotation by an axial support part 88 having the axial direction in the vertical direction. Meanwhile, the other ends 86B of the pair of arm members 86 are provided on the flange 12A and the flange 14A, and are supported to be capable of movement inside a long hole 90 extending in the long direction of the flange 12A and the flange 14A.

By this configuration, the pair of arm members 86 configuring the X arm 84 mutually rotate centered on the axial support part 82 when the opposing board 14 is moved away from the base board 12. Also, the other ends 86B of the arm members 86 move inside the long hole 90. The amounts of movement of the other ends 86B of the arm members 86 become equal because the center part of the arm members 86 is supported by the axial support part 82. The lengths of the diagonal lines on the bottom part surrounded on four sides by the pair of side wall boards 20, the base board 12, and the opposing board 14 thereby become equal.

(Operation and Effects)

The base board 12 and the opposing board 14 are overlaid in the state in which the foldable storage box 10 is folded, as illustrated in FIG. 2. Also, the side wall boards 20 in the folded state and the bottom board 36 in the stored state are disposed between the base board 12 and the opposing board 14. Also, the foldable storage box 10 does not take up space.

Figure 3:
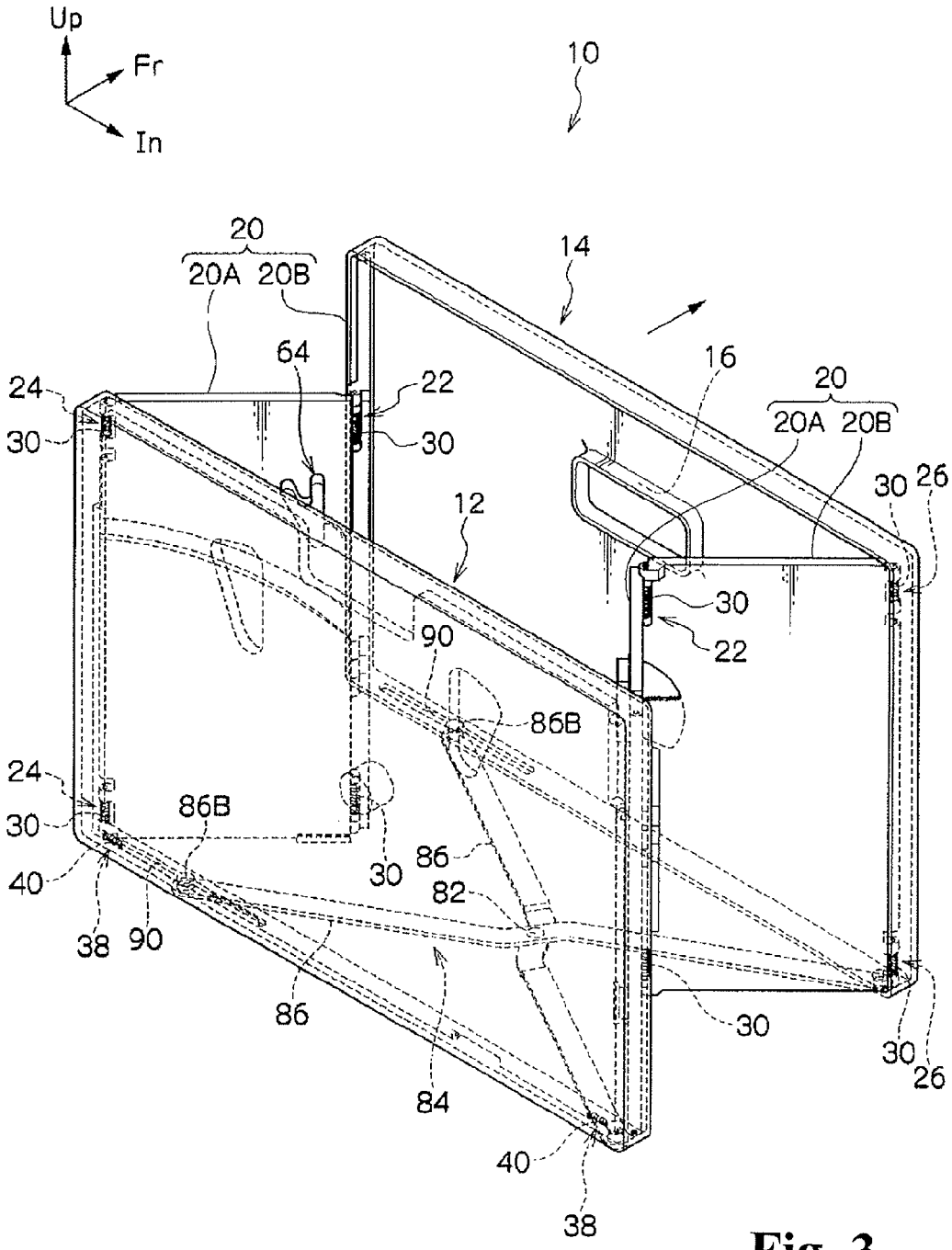
FIG. 3 is a perspective view illustrating the foldable storage box according to the first embodiment of the present invention.
Figure 4:
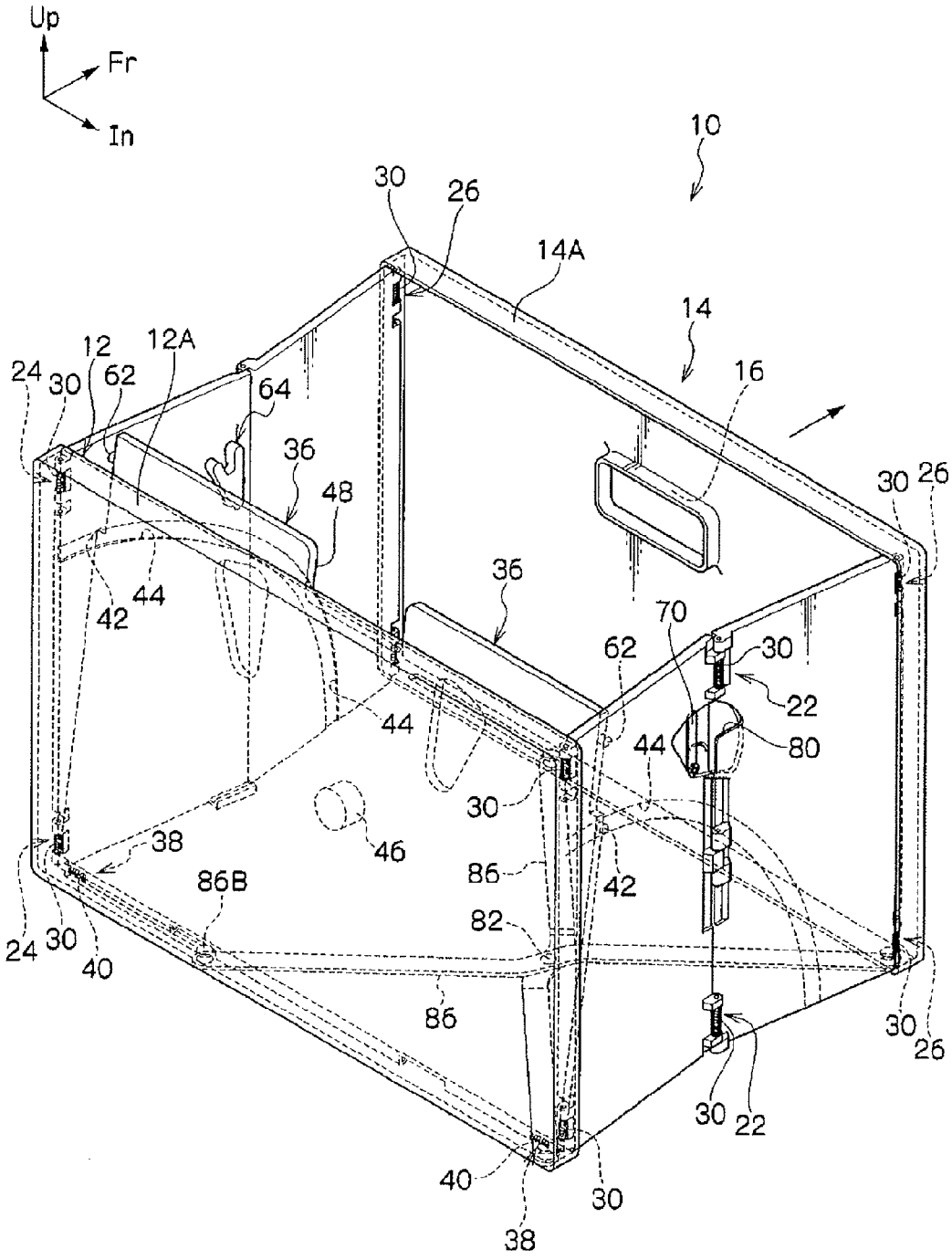
FIG. 4 is a bottom view illustrating the foldable storage box according to the first embodiment of the present invention.
Figure 5:
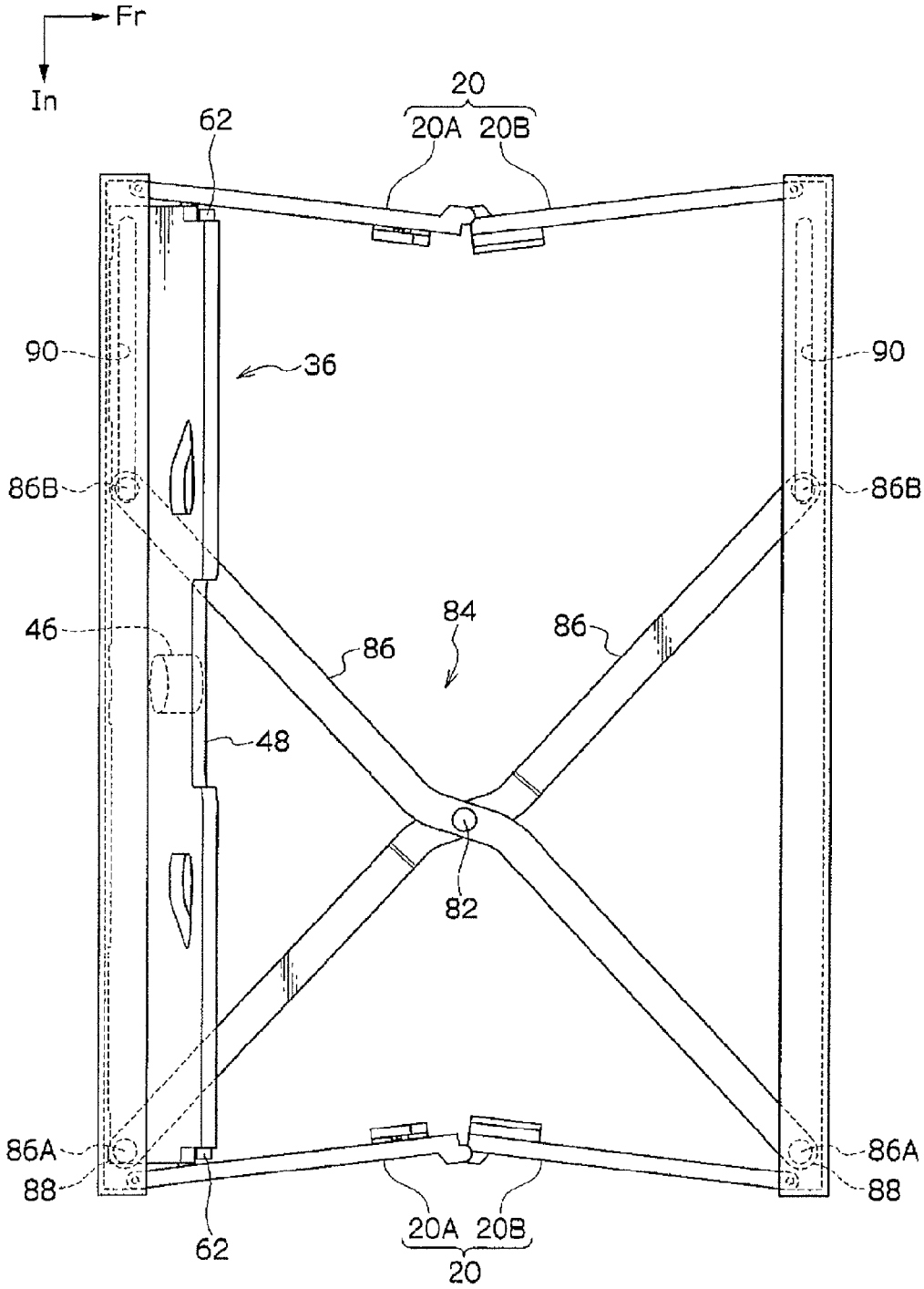
FIG. 5 is a bottom view illustrating the foldable storage box according to the first embodiment of the present invention.

The magnetic latch, not illustrated, is opened when the user grips the handle part 16 on the opposing board 14 and moves the opposing board 14 away from the base board 12 from this state, as illustrated in FIG. 3. Also, the other ends 86B of the arm members 86 of the X arm 84 move inside the long hole 90. Furthermore, the side wall boards 20 move out from the folded state to the open state in opposition to the urging force of the torsion coil springs 30.

The bottom board 36 begins to transition from the stored state to the open state by the urging force of the torsion coil spring 40 when the user grips the handle part 16 and moves the opposing board 14 further away from the base board 12, as illustrated in. FIGS. 4, 5, 7, and 9. Also, the guide groove 44 formed on the side wall boards 20 guides the guide pin 52 of the base board 36 beginning to transition to the open state.

The user moves the opposing board 14 away from the base board 12 while inserting a hand into the recessed part 48 of the bottom board 36 to transition the bottom board 36 to the open state, as illustrated in FIGS. 1, 6, 8, and 10. The other ends 86B of the arm members 86 then move to the end part of the long hole 90. Furthermore, the bottom surface of the guide groove 44 of the side wall boards 20 is pressed by the guide pin 42 of the bottom board 36, and the side wall boards 20 transition from the folded state to the open state. Also, the bottom board 36 becomes in the open state.

The pressing part 62 formed on the bottom board 36 presses the one projecting part 64B of the V form of the rotating member 64 when the bottom board 36 in the stored state is transitioned to the open state, as illustrated in FIGS. 11A, 11B, 12A, and 12B. The rotating member 64 thereby rotates and the other end 74B of the torsion coil spring 74 moves from the one end part of the arc hole 78 to the other end part. Also, the rotating member 64 stops with the opening of the V form of the rotating member 64 facing the side.

The rod-form lock member 70 is disposed so as to extend in the horizontal direction when in the stopped state of the rotating member 64. Also, the leading end part of the lock member 70 is inserted into the recessed pocket part 80 formed on the second side wall board 20B. The lock member 70 is disposed so as to span between the first side wall board 20A and the second side wall board 20B when the leading end part of the lock member 70 is inserted into the pocket part 80. In other words, the lock device 60 is disposed in the locked state in which the open state of the side wall boards 20 is locked. The foldable storage box 10 thereby becomes usable as a storage box.

Meanwhile, when folding up the foldable storage box 10 presently being usable, the user inserts a hand into the recessed part 48 of the bottom board 36 in the open state and transitions the bottom board 36 from the open state to the stored state, as illustrated in FIG. 1.

The pressing part 62 formed on the bottom board 36 presses the other projecting part 64C of the V form of the rotating member 64 when the bottom board 36 (see FIG. 4) in the open state is transitioned to the stored state, as illustrated in FIGS. 13A and 13B. The rotating member 64 and the lock member 70 thereby rotate, as illustrated in FIGS. 11A and 11B. The other end 74B of the torsion coil spring 74 thereby moves from the other end part of the arc hole 78 to the one end part. Also, the rotating member 64 stops with the opening of the V form of the rotating member 64 facing upward. In other words, the lock device 60 is disposed in the unlocked state in which the lock of the open state of the side wall boards 20 is unlocked.

The side wall boards 20 transition from the open state to the folded state by the urging force of the torsion coil springs 30 when the lock of the open state of the side wall boards 20 is unlocked. Also, the opposing board 14 is overlaid with the base board 12, the opposing board 14 and the base board 12 are latched by the magnetic latch, not illustrated, and the foldable storage box 10 is thus folded.

Thus, the lock device 60 locks the side wall board 20 in the open state when the bottom board 36 is transitioned from the stored state to the open state. The side wall boards 20 can therefore be easily held in the open state.

Also, the bottom surface of the guide groove 44 of the side wall boards 20 is pressed by the guide pin 42 of the bottom board 36, and the side wall boards 20 transition from the folded state to the open state, when the bottom board 36 is transitioned from the stored state to the open state. In other words, the foldable storage box 10 can be easily moved to a state usable as a storage box by just moving the bottom board 36 from the stored state to the open state.

Also, when folding the foldable storage box 10, the lock device 60 unlocks the lock of the side wall boards 20 locked in the open state when the bottom board 36 is transitioned from the open state to the stored state. The lock of the side wall boards 20 locked in the open state can therefore be easily unlocked.

Also, the lock of the side wall boards 20 locked in the open state is unlocked when the bottom board 36 is transitioned from the open state to the stored state. Also, the side wall boards 20 transition from the open state to the folded state by the urging force of the torsion coil springs 30. Furthermore, the opposing board 14 is latched by the magnetic latch to the base board 12, and the foldable storage box 10 is thus folded. In other words, the foldable storage box 10 can be easily folded by just transitioning the bottom board 36 from the open state to the stored state.

Also, the structure is such that elastic deformation of the torsion coil spring 74 is used to allow transition of the bottom board 36 from the stored state to the open state or from the open state to the stored state when the lock device 60 is in either state, being the locked state in which the side wall boards 20 are locked in the open state, or the unlocked state in which the lock is unlocked from the open state. The bottom board 36 can therefore be transitioned from the stored state to the open state or from the open state to the stored state when the lock device 60 gets transitioned to the locked state or the unlocked state without being pressed by the pressing part 62.

Also, the pair of arm members 86 configuring the X arm 84 rotate centered on the axial support part 82 when the opposing board 14 is moved away from the base board 12. The amounts of movement of the other ends 86B of the arm members 86 inside the long hole 90 thereby become identical. The lengths of the diagonal lines on the bottom part surrounded on four sides by the pair of side wall boards 20, the base board 12, and the opposing board 14 can therefore be made equal.

Also, warping of the foldable storage box 10 can be prevented by making the lengths of the diagonal lines on the bottom part surrounded on four sides by the pair of side wall boards 20, the base board 12, and the opposing board 14 equal.

Also, the operating force for the user to transition the bottom board 36 to the open state from the stored state can be lightened because the torsion coil spring 40 urges the bottom board 36 to the open state.

The present invention was described in detail with reference to a specific embodiment, but the present invention is not limited to such embodiment, and the fact that various other modes of working are possible within the scope of the present invention is obvious to those skilled in the art. For example, in the abovementioned embodiment, the bottom board 36 is axially supported on the base board 12, but the bottom board 36 may be axially supported on the opposing board 14.

Also, in the abovementioned embodiment, the operating force for the user to transition the bottom board 36 to the open state from the stored state is lightened by the urging force of the torsion coil spring 40, but the urging force of the torsion coil spring may be made stronger so that the bottom board is transitioned to the open state from the stored state by just the urging force of the torsion coil spring.

A second embodiment of a foldable storage box 100 of the present invention is next described in accordance with FIGS. 19 to 26.

The same members as in the first embodiment are assigned the same symbols and their descriptions are omitted.

Figure 19A:
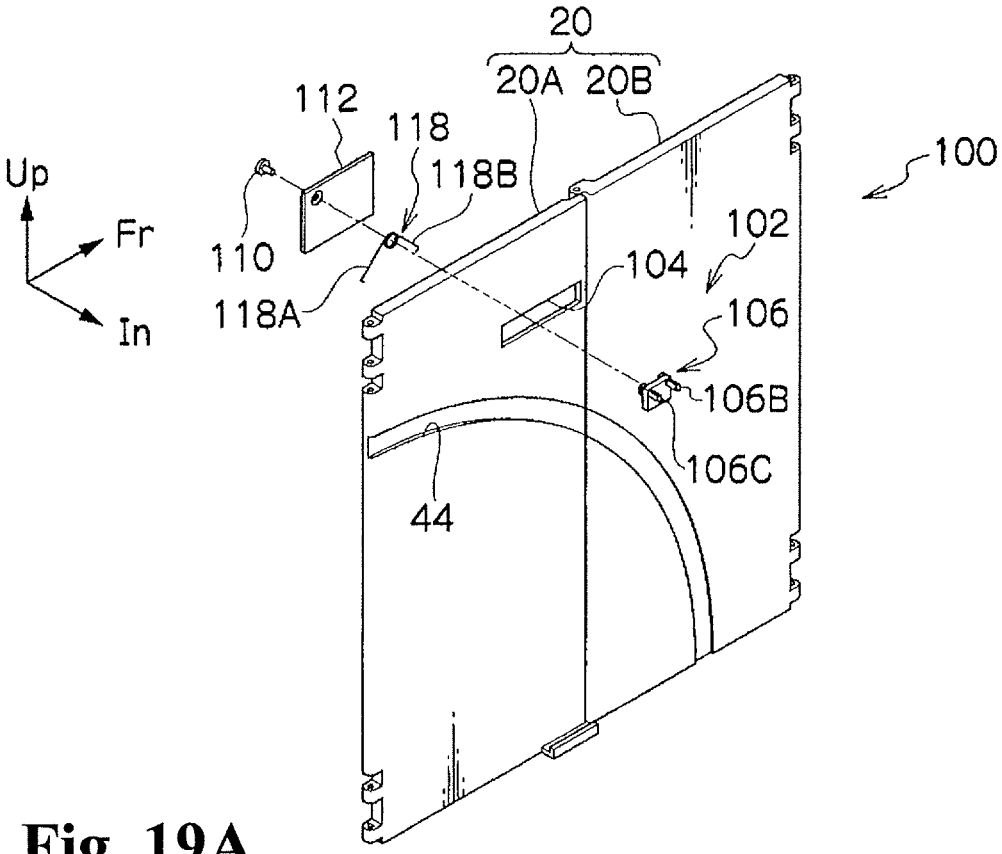
FIG. 19A is an exploded perspective view illustrating the side wall boards used in the foldable storage box according to the second embodiment of the present invention.
Figure 19B:
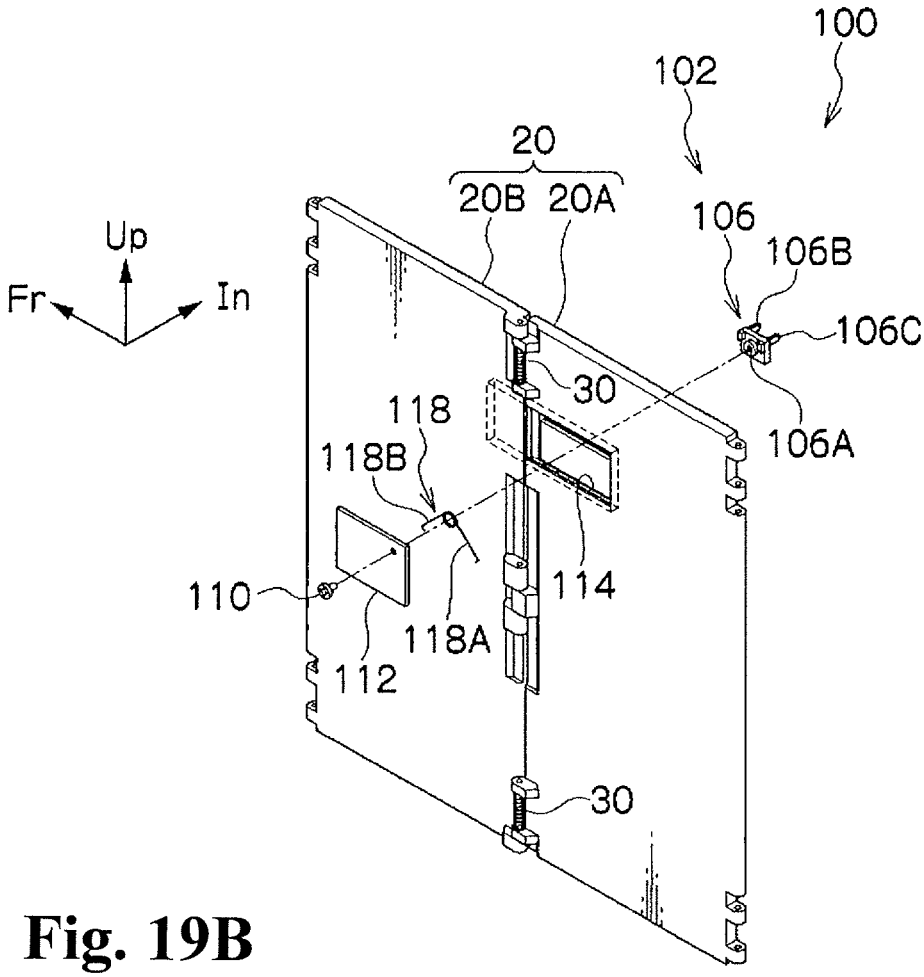
FIG. 19B is an exploded perspective view illustrating the side wall boards used in the foldable storage box according to the second embodiment of the present invention.
Figure 20A:
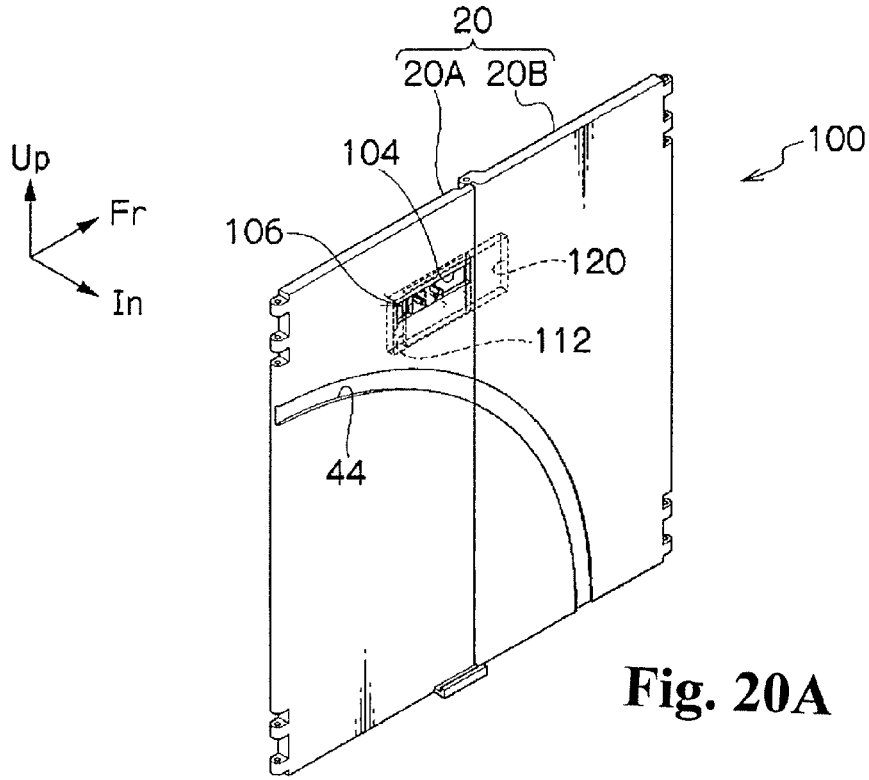
FIG. 20A is a perspective view illustrating the side wall boards used in the foldable storage box according to the second embodiment of the present invention.
Figure 20B:
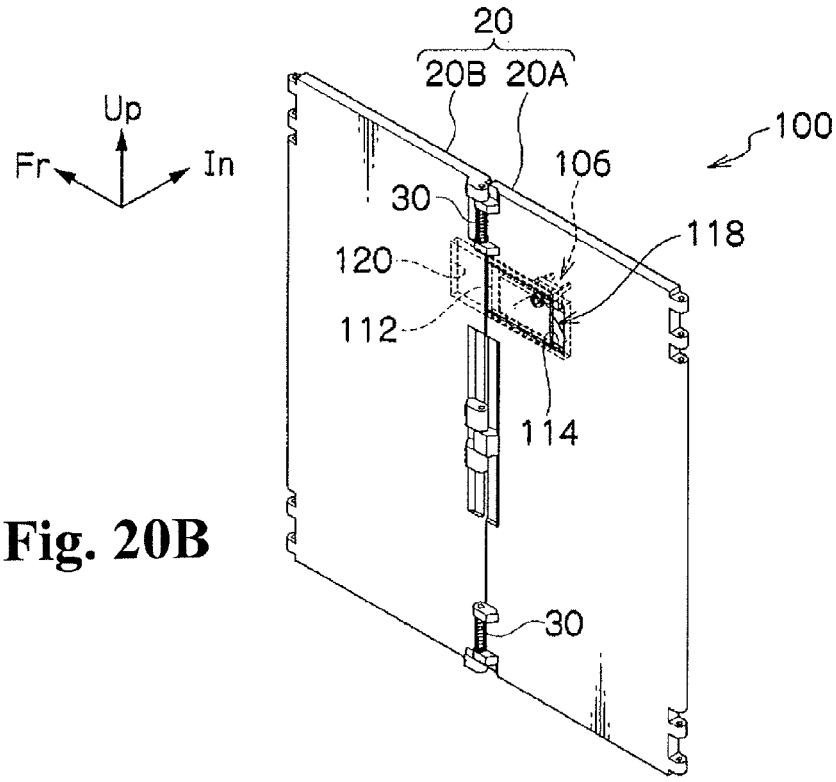
FIG. 20B is a perspective view illustrating the side wall boards used in the foldable storage box according to the second embodiment of the present invention.

A rotating member capable of rotation is not provided on a lock device 102 of the present second embodiment, as illustrated in FIGS. 19A and 19B. There is provided instead a moving member 106 made capable of movement inside a rectangular recessed part 104 formed on the first side wall board 20A, extending in the horizontal direction (direction in which the opposing board moves away from the base board).

Specifically, the lock device 102 includes a moving member 106 provided on the inner side (the side of the storage area of the foldable storage box 100) of the side wall boards 20, to be pressed to move inside the recessed part 104 by the pressing part 62 of the bottom board moving between the open state and the stored state. Furthermore, one projecting part 106B and another projecting part 106C, to be pressed by the moving pressing part 62, are provided at a distance in the horizontal direction on the front face (the face facing the side of the storage area) of the moving member 106.

A cylindrical boss 106A is integrally formed on the back face (the face facing the side of the side wall boards 20) of this moving member 106. Also, a flat rectangular board-form lock member 112 fixed by screw 110 to the boss 106A is provided on the outer side of the side wall boards 20.

This lock member 112 is fitted into a recessed part 114 formed on the outer side of the first side wall board 20A, and is made capable of movement in a direction moving closer and away from the second side wall board 20B.

Also, a torsion coil spring 118 is disposed on the boss 106A. Also, this torsion coil spring 118 is fixed to be incapable of rotation on the boss 106. Furthermore, one end 118A of the coil spring 118 extends diagonally downward so as to move away from the second side wall board 20B, and the leading end part is bent, as illustrated FIG. 22A. Meanwhile, the other end 118B of the coil spring 118 extends diagonally downward so as to move closer to the second side wall board 20B, and the leading end part is bent.

Figure 22A:
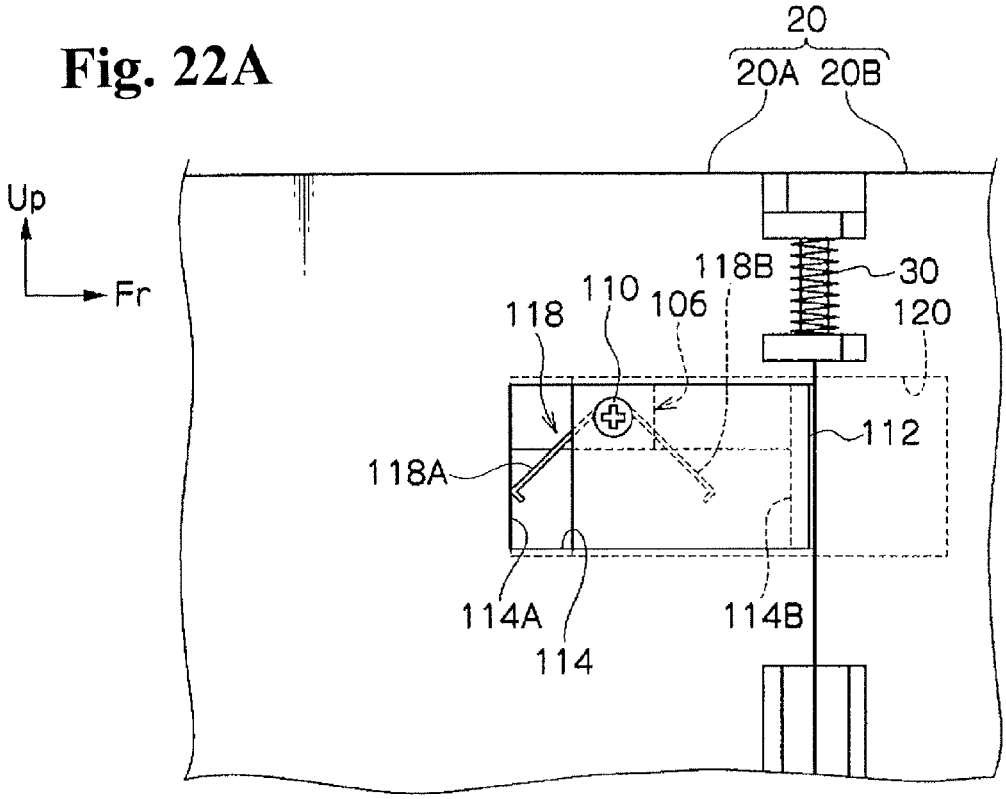
FIG. 22A is a side view illustrating the lock device used in the foldable storage box according to the second embodiment of the present invention.

The board-foam lock member 112 is disposed without spanning between the first side wall board 20A and the second side wall board 20B when the one end 118A of the coil spring 118 contacts one side edge part 114A of the recessed part 114, as illustrated in FIG. 22A. In other words, the lock device 102 is disposed in the unlocked state in which the lock of the open state of the side wall boards 20 is unlocked, when the one end 118A of the coil spring 118 contacts the one side edge part 114A of the recessed part 114, as illustrated in FIGS. 20A, 20B, 22A, and 22B.

Figure 22B:
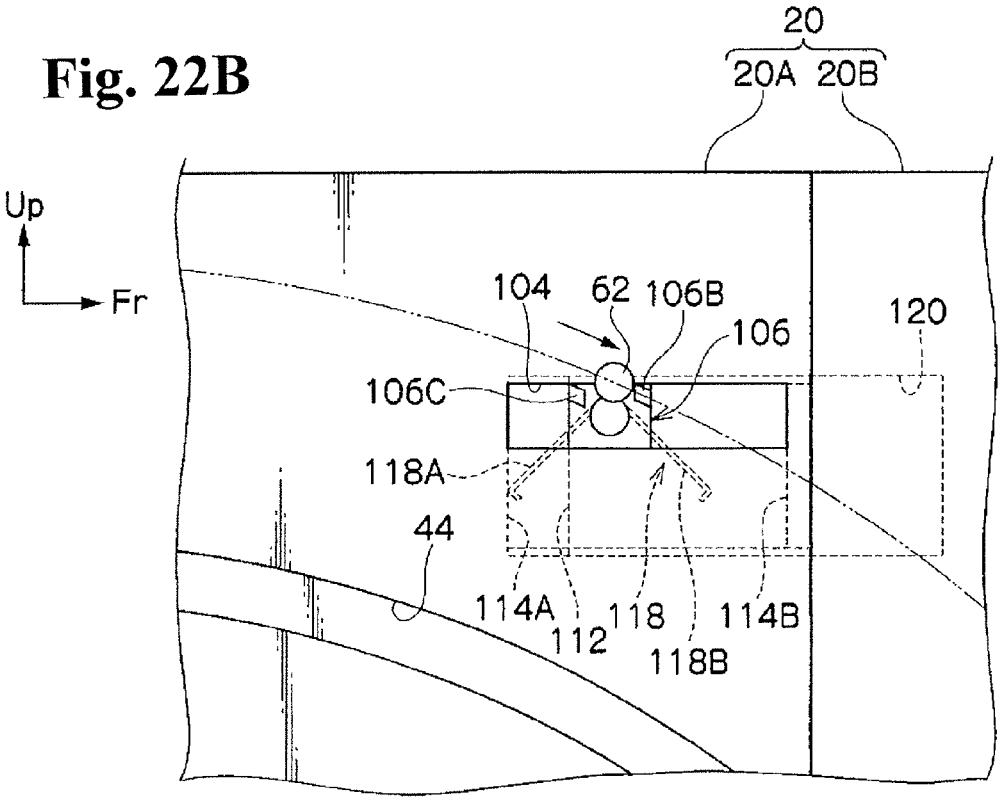
FIG. 22B is a side view illustrating the lock device used in the foldable storage box according to the second embodiment of the present invention.

As opposed to this, the configuration is such that the pressing part 62 formed on the bottom board presses the one projecting part 106B provided on the front face of the moving member 106 when the bottom board in the stored state is transitioned to the open state, as illustrated in FIG. 22B.

Figure 21A:
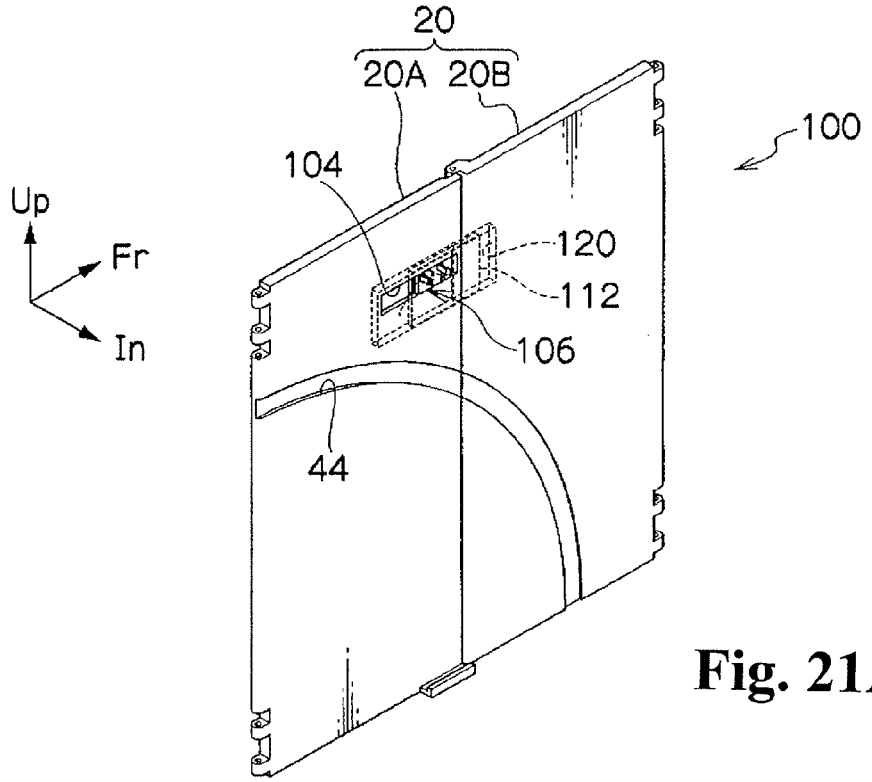
FIG. 21A is a perspective view illustrating the side wall boards used in the foldable storage box according to the second embodiment of the present invention.
Figure 23A:
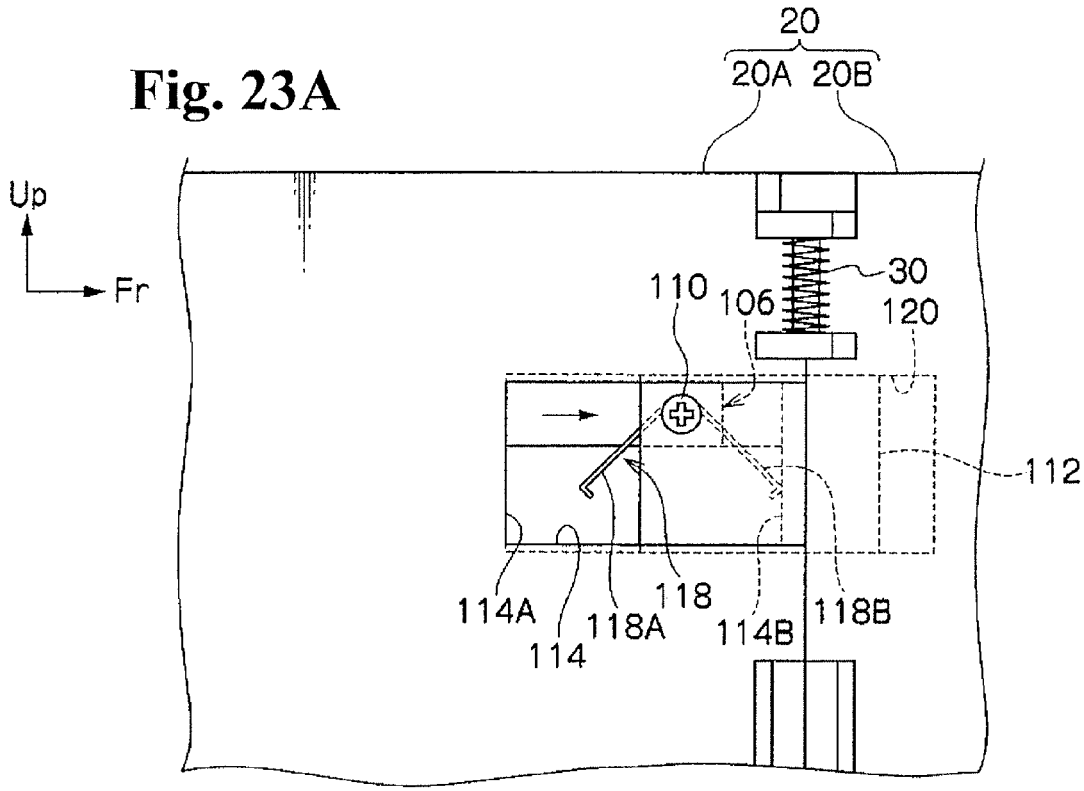
FIG. 23A is a side view illustrating the lock device used in the foldable storage box according to the second embodiment of the present invention.
Figure 23B:
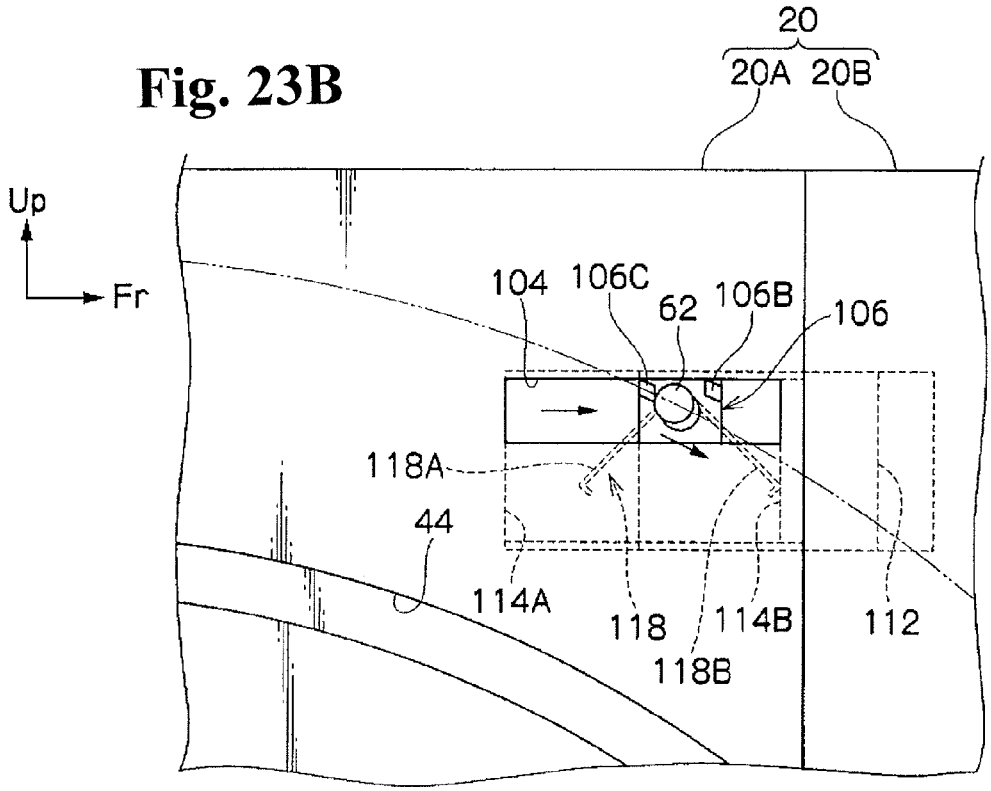
FIG. 23B is a side view illustrating the lock device used in the foldable storage box according to the second embodiment of the present invention.

Also, the moving member 106 moves toward the second side wall board 20B when the one projecting part 106B of the moving member 106 is pressed, as illustrated FIGS. 21A and 23B. Also, the moving member 106 stops with the other end 118B of the torsion coil spring 118 contacts the other side edge part 114B of the recessed part 114.

Figure 21B:
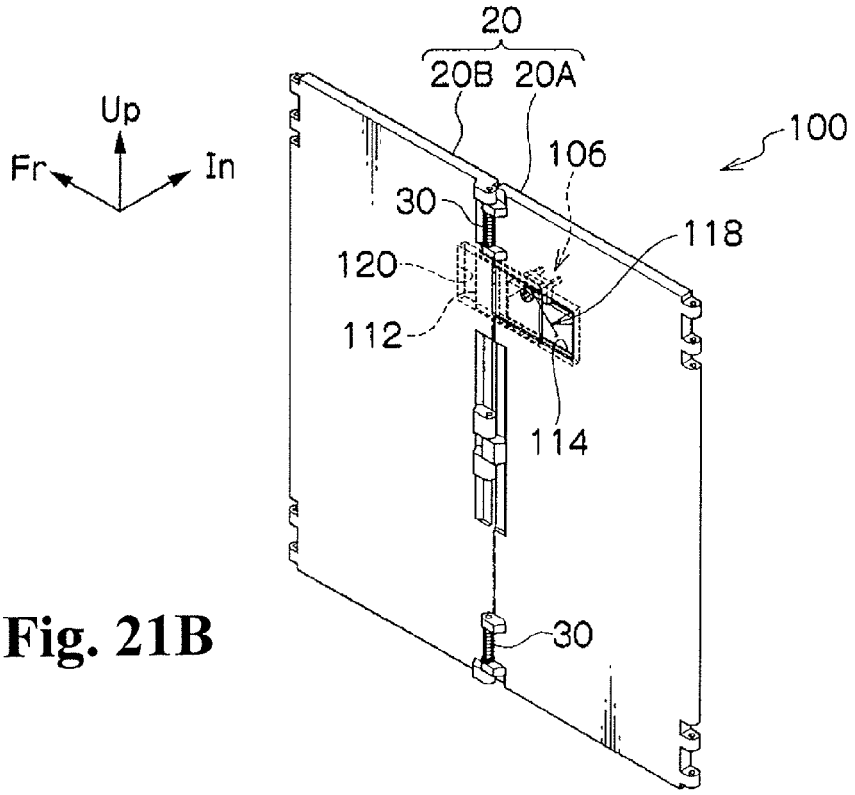
FIG. 21B is a perspective view illustrating the side wall boards used in the foldable storage box according to the second embodiment of the present invention.

The leading end of the board-form lock member 112 is inserted into a recessed pocket part 120 formed on the second side wall board 20B when in the stopped state of this moving member 106, as illustrated in FIGS. 21B and 23A. Also, the lock member 112 is disposed so as to span between the first side wall board 20A and the second side wall board 20B. In other words, the lock device 102 is disposed so as to lock the side wall boards 20 in the open state when the other end 118B of the coil spring 118 contacts the other side edge part 114B of the recessed part 114.

Figure 24A:
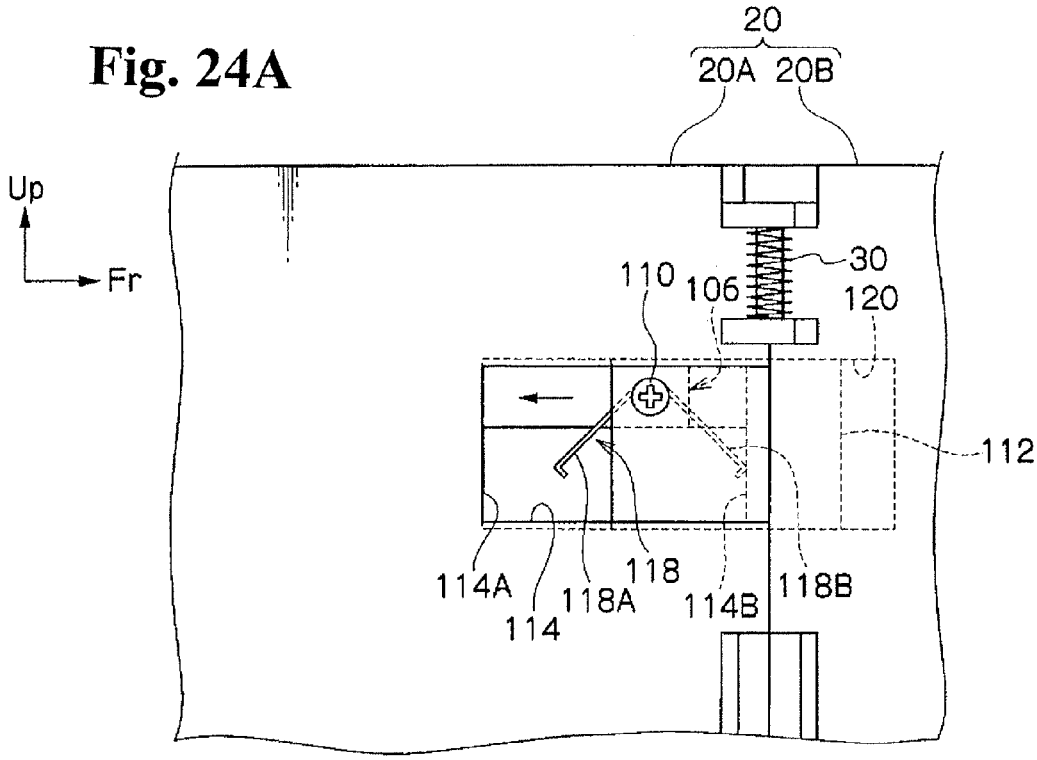
FIG. 24A is a side view illustrating the lock device used in the foldable storage box according to the second embodiment of the present invention.
Figure 24B:
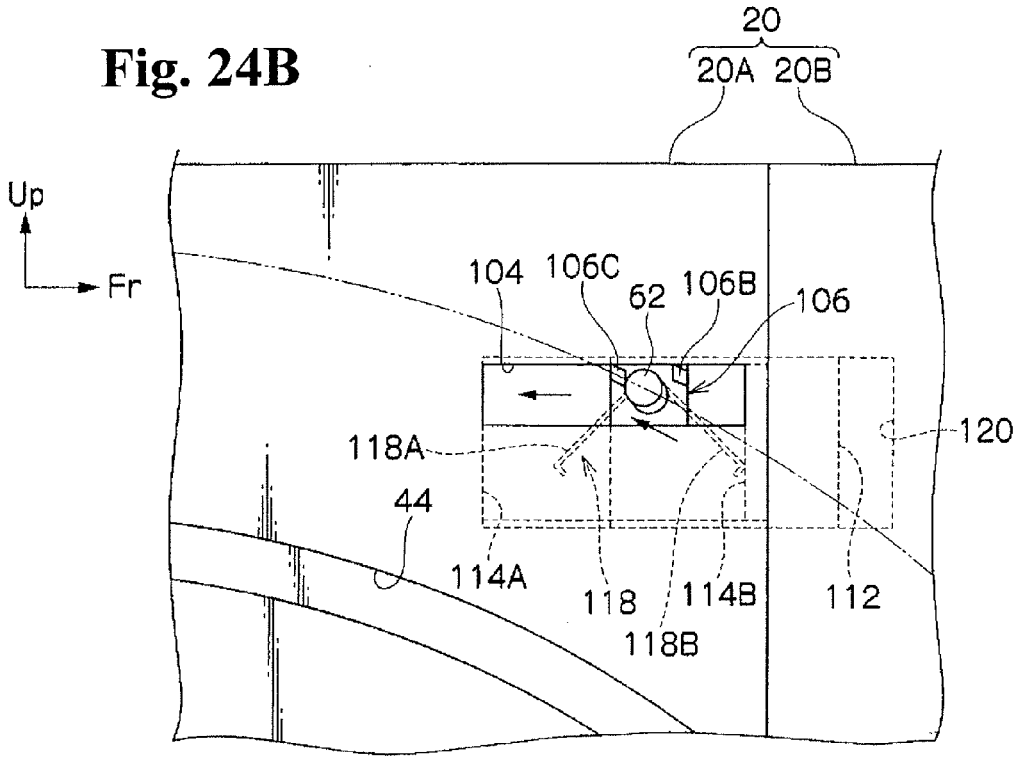
FIG. 24B is a side view illustrating the lock device used in the foldable storage box according to the second embodiment of the present invention.

Meanwhile, the configuration is such that the pressing part 62 formed on the bottom board presses the other projecting part 106C of the moving member 106 when the bottom board in the open state is transitioned to the stored state, as illustrated in FIGS. 24A and 24B. The moving member 106 and the lock member 112 thereby move, and the one end 118A of the torsion coil spring 118 contacts the one side edge part 114A of the recessed part 114, as illustrated in FIGS. 22A and 22B. Also, the moving member 106 comes to stop. In other words, the lock device 102 is disposed in the unlocked state in which the lock of the open state of the side wall boards 20 is unlocked.

Figure 25A:
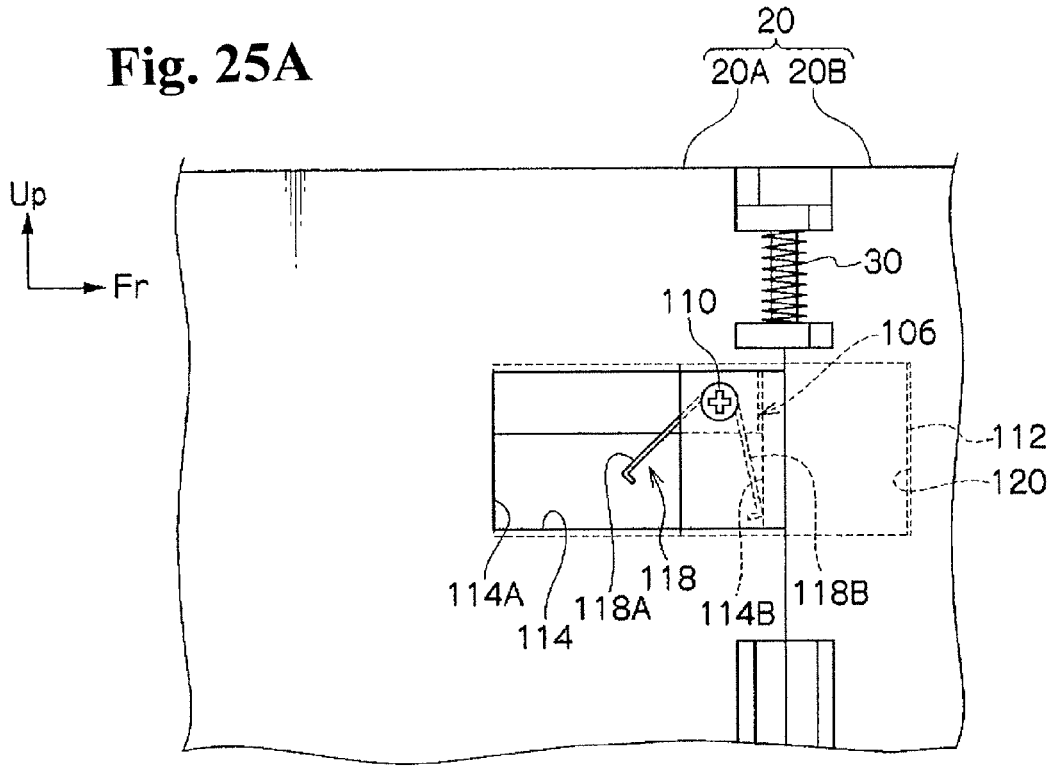
FIG. 25A is a side view illustrating the lock device used in the foldable storage box according to the second embodiment of the present invention.
Figure 25B:
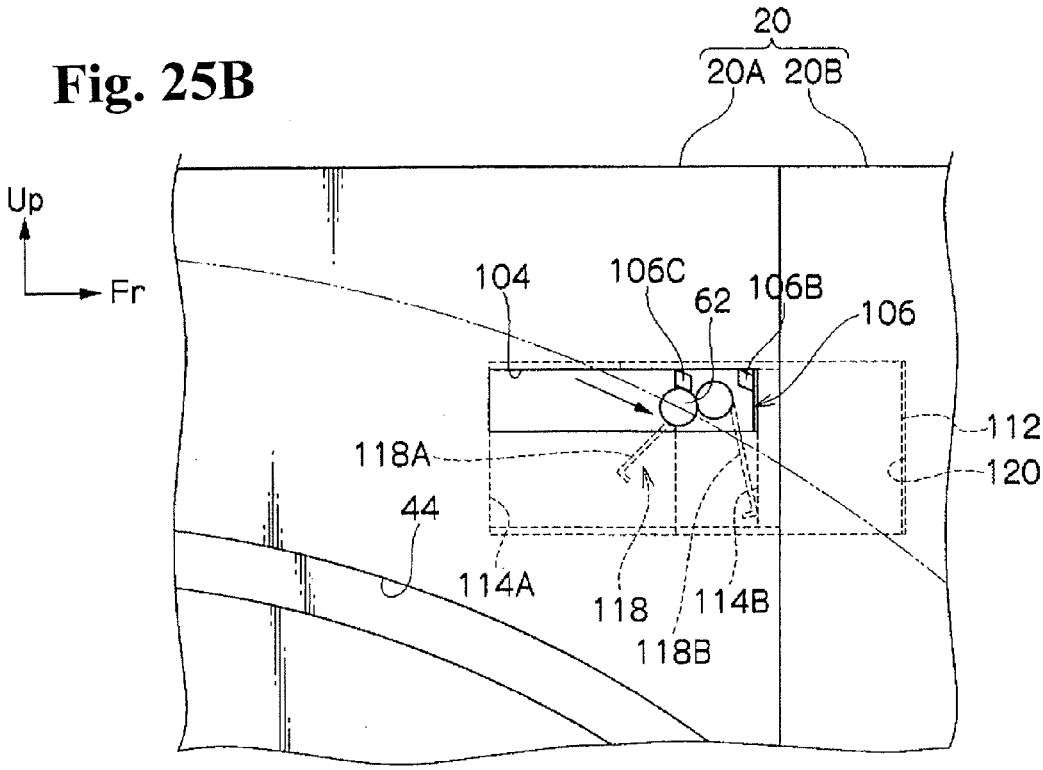
FIG. 25B is a side view illustrating the lock device used in the foldable storage box according to the second embodiment of the present invention.

As opposed to this, the bottom board in the stored state is transitioned to the open state in the case when the lock device 102 is disposed in the locked state despite the fact that the bottom board is disposed in the stored state, as illustrated in FIGS. 25A and 25B. The configuration is such that the pressing part 62 formed on the bottom board 62 then presses the other projecting part 106C of the moving member 106. The moving member 106 subject to pressing of the other projecting part 106C elastically deforms the torsion coil spring 118 and moves so as to withdraw from the track of movement. Also, the moving member 106 is configured to allow movement of the pressing part 62. After passing the pressing part 62, the moving member 106 returns to the locked state by the urging force of the torsion coil spring 118.

Figure 26A:
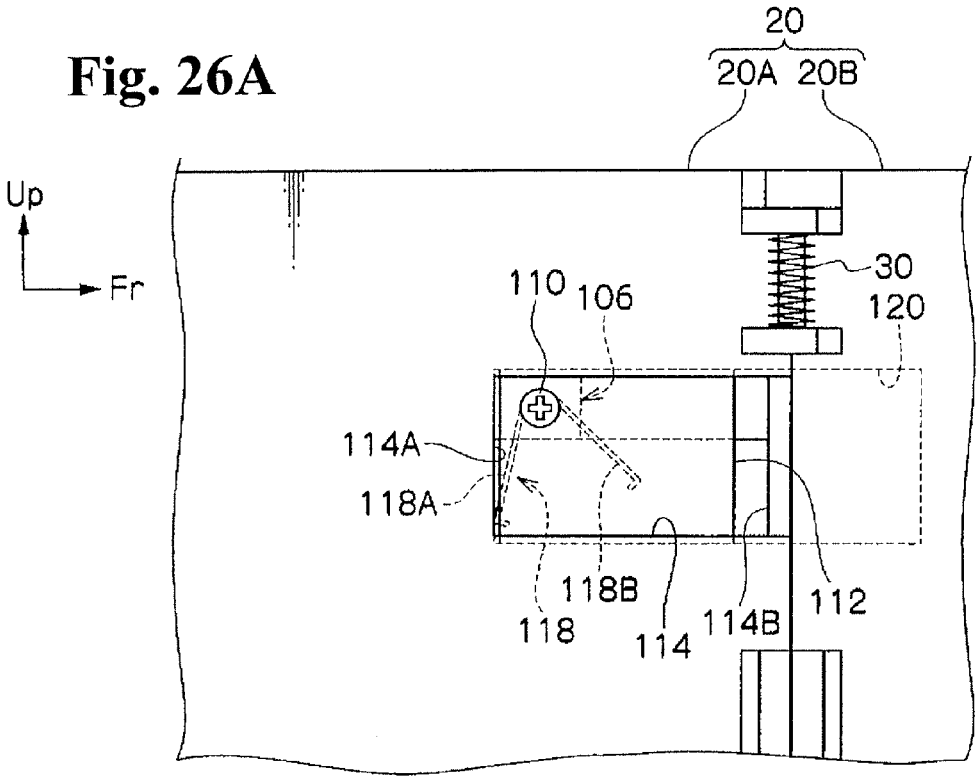
FIG. 26A is a side view illustrating the lock device used in the foldable storage box according to the second embodiment of the present invention.
Figure 26B:
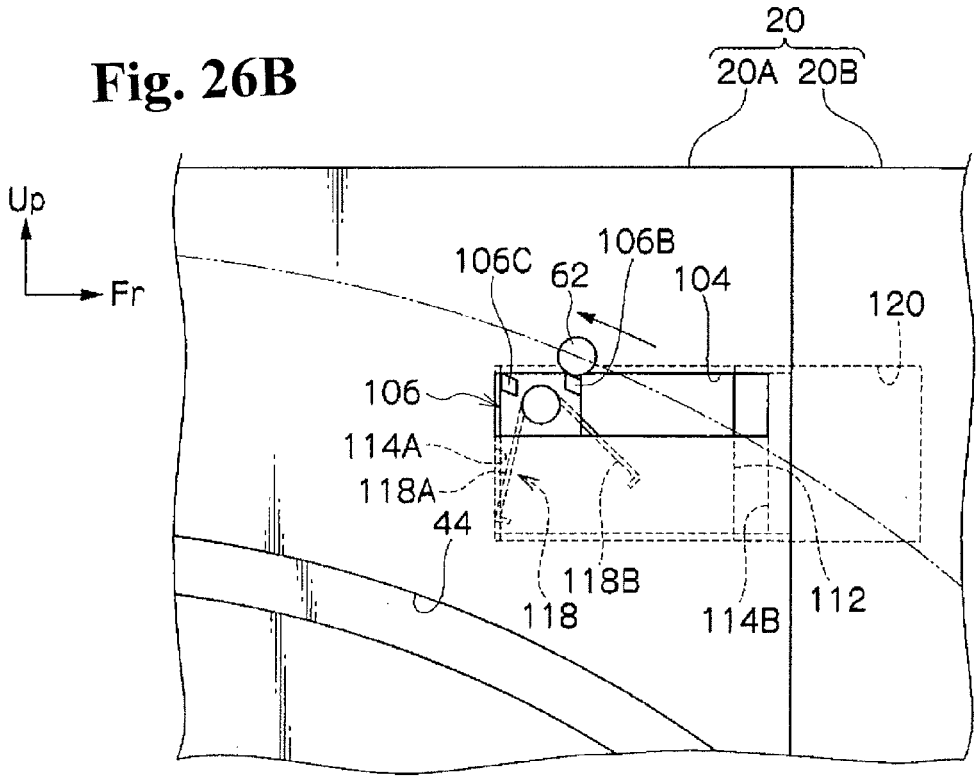
FIG. 26B is a side view illustrating the lock device used in the foldable storage box according to the second embodiment of the present invention.

Furthermore, the bottom board in the open state is transitioned to the stored state in the case when the lock device 102 is disposed in the locked state despite the fact that the bottom board is disposed in the open state, as illustrated in FIGS. 26A and 26B. The configuration is such that the pressing part 62 formed on the bottom board then presses the one projecting part 106B of the moving member 106. The moving member 106 subject to pressing of the one projecting part 106B elastically deforms the torsion coil spring 118 and moves so as to escape from the track of movement. Also, the moving member 106 is configured to allow movement of the pressing part 62. After passing the pressing part 62, the moving member 106 returns to the unlocked state by the urging force of the torsion coil spring 118.

10 Foldable storage box
12 Base board
14 Opposing board
20 Side wall board
30 Torsion coil spring (side wall urging member)
36 Bottom board
40 Torsion coil spring (bottom board urging member)
58 Lock unit
60 Lock device
62 Pressing part
74 Torsion coil spring (transition allowing member)
84 X arm (separating member)
100 Foldable storage box
102 Lock device
118 Torsion coil spring (transition allowing member)

What is claimed is:

1. A foldable storage box, comprising:

a rectangular base board;

an opposing board opposing against said base board;

a pair of side wall boards connected between a side edge of said base board and a side edge of said opposing board, said pair of side wall boards in a folded state allowing said base board and said opposing board move closer and becoming an open state from the folded state when said opposing board is moved away from said base board, said pair of side wall boards surrounding four sides together with said base board and said opposing board in the open state;

a bottom board disposed in a stored state to be overlaid with said base board and said opposing board when in the folded state of said side wall boards, and axially supported to rotate freely on said base board or said opposing board, said bottom board transitioning from the stored state to the open state by moving rotatably to form a bottom part surrounded on four sides by said pair of side wall boards, said base board, and said opposing board, when said opposing board is moved away from said base board and said side wall boards are transitioned to the open state from the folded state;

lock units attached to the side wall boards, each of the lock units locking each of said side wall boards in the open state when said bottom board is transitioned to the open state from the stored state; and a side wall urging member urging said side wall boards to transition to the folded state.

2. A foldable storage box according to claim 1, wherein each of said lock units unlocks a lock of each of said side wall boards locked in the open state when said bottom board is transitioned to the stored state from the open state.

3. A foldable storage box according to claim 1, further comprising a bottom board urging member connected to the bottom board, said bottom board urging member urging said bottom board to the open state.

4. A foldable storage box, comprising:

a rectangular base board;

an opposing board opposing against said base board;

a pair of side wall boards connected between a side edge of said base board and a side edge of said opposing board, said pair of side wall boards in a folded state allowing said base board and said opposing board move closer and becoming an open state from the folded state when said opposing board is moved away from said base board, said pair of side wall boards surrounding four sides together with said base board and said opposing board in the open state;

a bottom board disposed in a stored state to be overlaid with said base board and said opposing board when in the folded state of said side wall boards, and axially supported to rotate freely on said base board or said opposing board, said bottom board transitioning from the stored state to the open state by moving rotatably to form a bottom part surrounded on four sides by said pair of side wall boards, said base board, and said opposing board, when said opposing board is moved away from said base board and said side wall boards are transitioned to the open state from the folded state; and lock units attached to the side wall boards, each of the lock units locking each of said side wall boards in the open state when said bottom board is transitioned to the open state from the stored state, wherein each of said lock units comprises: a pressing part disposed on said rotating bottom board; and a lock device provided on each of said side wall boards, said lock device being pressed by said pressing part to lock said side wall board in the open state or to unlock the lock from the open state.

5. A foldable storage box according to claim 4, further comprising a transition allowing member attached to the lock unit, said transition allowing member allowing transition of said bottom board from the stored state to the open state or from the open state to the stored state, in either a locked state in which said side wall boards are locked in the open state, or an unlocked state in which the lock is unlocked.

6. A foldable storage box according to claim 4, wherein each of said lock units unlocks a lock of each of said side wall boards locked in the open state when said bottom board is transitioned to the stored state from the open state.

7. A foldable storage box according to claim 4, further comprising a bottom board urging member attached to the bottom board, the bottom board urging member urging said bottom board to the open state.

8. A foldable storage box, comprising:

a rectangular base board;

an opposing board provided opposing against said base board;

a pair of side wall boards, each being connected between a side edge of said base board and a side edge of said opposing board, said base board and said opposing board moving closer in a folded state where the pair of side wall boards are folded, and said base board and said opposing board being moved away from each other to form four sides together with said pair of side wall boards in an open state where the pair of side wall boards are unfolded;

a bottom board axially supported to rotate freely on said base board or said opposing board, the bottom board being overlaid with said base board and said opposing board in the folded state, and said bottom board moving rotatably to form a bottom part surrounded on the four sides formed with said pair of side wall boards, said base board, and said opposing board in the open state; and a separating member including a pair of arm members connecting the base board and the opposing board to cross in an X-shape therebetween, and an axial support part disposed at an intersection portion of the pair of arm members to mutually rotate the pair of arm members thereat, the separating member moving said opposing board away from said base board such that lengths of diagonal lines on the bottom part surrounded on the four sides formed with said pair of side wall boards, said base board, and said opposing board become equal in the open state, wherein each of the pair of side wall boards has a guide groove on an inner surface thereof, and the bottom board has two guide pins, each protruding outwardly from a side portion thereof; and the guide pin slides in the guide groove to rotate the bottom board.

9. A foldable storage box according to claim 8, wherein one end of one arm member is rotatably arranged at one end portion of the base board and another end of the one arm member is slidably arranged at the opposing board diagonal to the one end portion of the base board, and one end of another arm member is rotatably arranged at one end portion of the opposing board at a side opposite to the one end portion of the base board and another end of the another arm member is slidably arranged at the base board diagonal to the one end portion of the opposing board.

10. A foldable storage box according to claim 9, wherein the base board includes a first flange portion protruding inwardly from a lower edge thereof and having a first hole portion extending in a longitudinal direction of the base board on the first flange; the opposing board includes a second flange portion protruding inwardly from a lower edge thereof and having a second hole portion extending in a longitudinal direction of the opposing board on the second flange portion; and the another end of the one arm member is arranged in the second hole of the opposing board, and the another end of the other arm member is arranged in the first hole of the base board.

* * * * *